US010987564B2

(12) United States Patent
Tsai

(10) Patent No.: US 10,987,564 B2
(45) **Date of Patent: *Apr. 27, 2021**

(54) BALL STOWABLE SUPPORT

(71) Applicant: Medal Sports (Taiwan) Corporation, Taipei (TW)

(72) Inventor: Kevin Chunhao Tsai, Kaohsiung (TW)

(73) Assignee: Medal Sports (Taiwan) Corporation

( * ) Notice: Subject to any disclaimer, the term of this patent is extended or adjusted under 35 U.S.C. 154(b) by 136 days.

This patent is subject to a terminal disclaimer.

(21) Appl. No.: 16/059,780

(22) Filed: Aug. 9, 2018

(65) Prior Publication Data

US 2019/0118061 A1 Apr. 25, 2019

Related U.S. Application Data

(63) Continuation-in-part of application No. 15/793,749, filed on Oct. 25, 2017, now Pat. No. 10,493,342.

(51) Int. Cl.

| | |
|---|---|
| ***A63B 67/00*** | (2006.01) |
| ***A63B 63/00*** | (2006.01) |
| ***A63B 47/00*** | (2006.01) |
| ***A63B 1/00*** | (2006.01) |
| ***A63B 71/00*** | (2006.01) |
| ***A63B 69/00*** | (2006.01) |

(52) U.S. Cl.

CPC ..... *A63B 71/0036* (2013.01); *A63B 47/00* (2013.01); *A63B 69/0095* (2013.01); *A63B 2067/005* (2013.01); *A63B 2210/50* (2013.01); *A63B 2243/0095* (2013.01)

(58) Field of Classification Search

CPC ..... A63B 63/00; A63B 63/007; A63B 67/002; A63B 67/04; A63B 2067/005; A63B 5/11; A63B 47/00; A63B 1/00; A63B 2210/50; A63B 71/0036; A63B 69/0095; A63B 2243/0095

See application file for complete search history.

(56) References Cited

U.S. PATENT DOCUMENTS

| | | | | | |
|---|---|---|---|---|---|
| 2,809,383 | A * | 10/1957 | Fenner | A47C 17/705 | 482/28 |
| 4,284,271 | A * | 8/1981 | Pettit | A63B 5/11 | 182/139 |
| 5,545,110 | A * | 8/1996 | Hsiang | A63B 5/11 | 482/27 |
| 5,566,948 | A * | 10/1996 | Kidd | A63B 63/08 | 273/342 |
| 5,967,943 | A * | 10/1999 | Rich | A63B 5/11 | 182/37 |
| 6,001,045 | A * | 12/1999 | Gift | A63B 5/11 | 482/27 |
| 6,129,649 | A * | 10/2000 | Yang | A63B 5/11 | 482/27 |
| 6,193,632 | B1 * | 2/2001 | Steger | A63B 5/11 | 482/27 |

(Continued)

*Primary Examiner* — Raleigh W Chiu

(74) *Attorney, Agent, or Firm* — John R. Kasha; Kelly L. Kasha; Kasha Law LLC

(57) ABSTRACT

An apparatus for a ball stowable support is provided. The apparatus includes a frame, an elastic cover secured to the frame, and at least one leg supporting the frame. Each leg of the at least one leg has an opening. The opening is configured to retain a ball.

12 Claims, 18 Drawing Sheets

(56) References Cited

U.S. PATENT DOCUMENTS

| | | | | |
|---|---|---|---|---|
| 6,261,207 | B1 * | 7/2001 | Publicover | A63B 5/11 482/27 |
| 8,807,568 | B1 * | 8/2014 | Ruder | A63B 67/002 273/342 |
| 9,717,940 | B1 * | 8/2017 | Schueler | A63B 5/11 |
| 9,844,713 | B1 * | 12/2017 | Kaufmann | A63B 69/0071 |
| 10,493,342 | B2 * | 12/2019 | Tsai | A63B 63/007 |
| 2005/0137061 | A1 * | 6/2005 | Wang | A63B 5/11 482/28 |
| 2006/0113316 | A1 * | 6/2006 | Kilgore | A47F 1/082 221/303 |
| 2006/0128529 | A1 * | 6/2006 | Adams | A63B 5/11 482/27 |
| 2007/0072738 | A1 * | 3/2007 | Lai | A63B 5/11 482/28 |
| 2010/0041519 | A1 * | 2/2010 | Law | A63B 71/023 482/27 |
| 2016/0096056 | A1 * | 4/2016 | de Boer | A63B 5/11 482/27 |
| 2016/0310774 | A1 * | 10/2016 | Publicover | A63B 5/11 |
| 2017/0239504 | A1 * | 8/2017 | Chen | A63B 5/11 |
| 2017/0312644 | A1 * | 11/2017 | Meir | A63B 5/11 |
| 2017/0361143 | A1 * | 12/2017 | Mehr | A63B 5/11 |
| 2018/0093120 | A1 * | 4/2018 | Chen | A63B 5/11 |
| 2018/0290000 | A1 * | 10/2018 | Chen | A63B 5/11 |
| 2018/0353789 | A1 * | 12/2018 | Tseng | A63B 5/11 |
| 2018/0369629 | A1 * | 12/2018 | Publicover | A63B 5/11 |
| 2019/0009120 | A1 * | 1/2019 | Ji | A63B 5/11 |

* cited by examiner

BALL STOWABLE SUPPORT

CROSS-REFERENCE TO RELATED APPLICATION

This U.S. patent application is a continuation-in-part of U.S. non-provisional application Ser. No. 15/793,749 filed on Oct. 25, 2017 the disclosure of which is considered part of the disclosure of this application and is hereby incorporated by reference in its entirety.

FIELD

The present disclosure relates generally to a volleyball spike game support and more particularly to a support for stowing a ball for the volleyball spike game.

BACKGROUND

This section provides background information related to the present disclosure and is not necessarily prior art.

Collaborative and competitive games often have multiple components necessary to play the game. Although multiple components enable games to have countless variations and different levels of complexity, multiple components may require increased transportation and increased storage organization among other things. For example, a chess player who transports a chess game needs to transfer each chess piece in order to play the game properly. Similarly, a volleyball spike game can have multiple components that are required to play the game properly. In that respect, if during transport or storage a volleyball spike game player misplaces or loses a component, the player may not be able to play the game. For example, a player may misplace a ball used to play the volleyball spike game and render the game inoperable. Moreover, a risk of compromising the volleyball spike game may increase because the volleyball spike game is commonly a mobile game. This means that a player often transports the volleyball spike game to different locations to play, such as, for example, a beach or a backyard. Therefore, although systems and methods of transportation and organization of volleyball spike games may exist, there remains a continuous need for improvement in the art.

SUMMARY

This section provides a general summary of the disclosure, and is not a comprehensive disclosure of its full scope or all of its features.

Implementations of the disclosure may include one or more of the following optional features. In some implementations, each leg of the at least one leg is pivotably attached to the frame. Additionally or alternatively, each leg may be pivotably attached to the frame at a frame receiving end having a distal side and a proximal side. The frame receiving end may have an opening extending from the distal side to the proximal side configured to receive a portion of the frame. The opening of the pivotable frame receiving end may have a radius of curvature corresponding to a radius of curvature of the frame. Each leg may have a ground-engaging state and a stowed state. The pivotable attachment of each leg may have approximately 90 degrees of rotation between the stowed state and the ground-engaging state. In the stowed state, each leg may be approximately parallel to the elastic cover. Optionally, in the ground engaging state, the opening of the frame receiving end may be approximately perpendicular to the opening configured to retain the ball.

In some examples, each leg has a front side, a rear side, and an inner wall defining the opening. The inner wall may taper through the opening from the front side to the rear side. The inner wall may also have slits, each slit extending from the rear side towards the front side. The ball may range from 2.5 inches to 8 inches in diameter.

Another aspect of the disclosure provides a leg for a volleyball spike game. The leg includes a front side and a rear side opposite the front side. The leg also includes a pivotable frame receiving end extending from the front side to the rear side. The pivotable frame receiving end has a distal side, a proximal side, and a frame receiving opening extending from the distal side to the proximal side. The leg further includes a ground engaging end opposite the pivotable frame receiving end. The leg also includes a middle portion having an inner wall and an outer wall, the inner wall defining an opening configured to retain a ball.

Implementations of the disclosure may include one or more of the following optional features. In some configurations, the frame receiving opening has a radius of curvature operable to receive a curved frame member. Optionally, the opening of the middle portion may have a middle portion opening axis perpendicular to an axis of the frame receiving opening when the leg supports the volleyball spike game.

In some examples, the inner wall tapers from the front side to the rear side to define a tapered opening. The tapered opening may be configured to retain the ball having a diameter ranging from 2.5 inches to 8 inches. Here, the tapered opening at the rear side may have a diameter less than a diameter of the ball. Additionally or alternatively, the inner wall may have slits extending along a length of the tapered opening from the rear side towards the front side.

In some implementations, the pivotable frame receiving end pivots about an axis of the frame receiving opening. Here, the pivotable frame receiving end may pivot approximately ninety degrees from a stowed position to a ground engaging position about the axis of the frame receiving opening.

Another aspect of the disclosure provides a method for making a leg for a volleyball spike game. The method includes providing a moldable material and forming a leg. The leg includes a front side, a rear side opposite the front side, and a pivotable frame receiving end extending from the front side to the rear side. The pivotable frame receiving end has a distal side, a proximal side, and a frame receiving opening extending from the distal side to the proximal side. The frame receiving opening is configured to receive a portion of a frame. The pivotable frame receiving end is pivotable between a support position and a stowed position. The stowed position positions the leg parallel to a playing surface of the volleyball spike game. The leg also includes a ground engaging end opposite the pivotable frame receiving end. The leg further includes a middle portion having an inner wall and an outer wall. The inner wall defines a tapered opening configured to retain a ball.

Implementations of the disclosure may include the following optional feature. In some implementations, the ball has at least one diameter selected from a range consisting of 2.5 inches to 8 inches.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected configurations and not all possible implementations, and are not intended to limit the scope of the present disclosure.

Corresponding reference numerals indicate corresponding parts throughout the drawings.

DETAILED DESCRIPTION

Figure 1A:
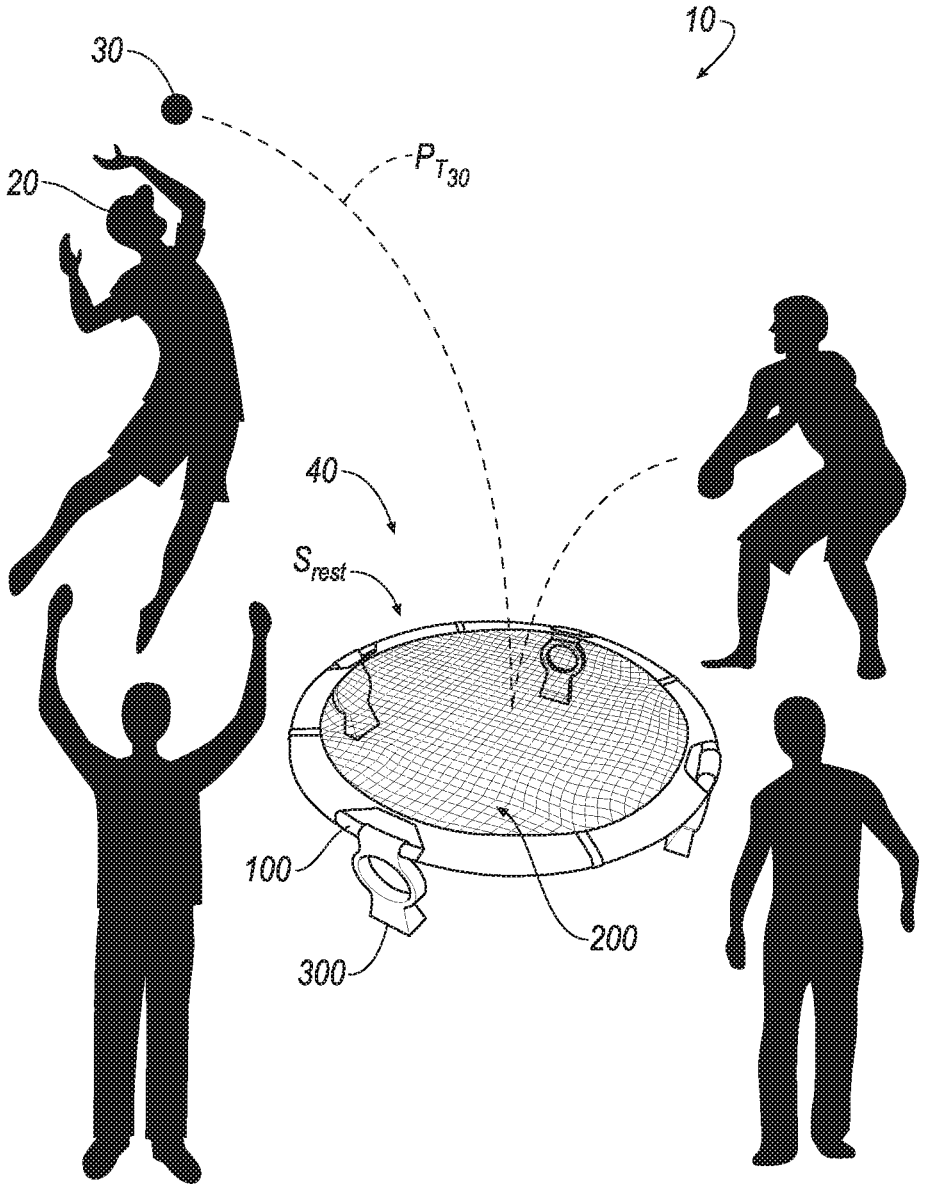
FIG. 1A is a perspective view of an example volleyball spike game environment.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

FIG. 1 is an example of a volleyball spike game environment 10. The volleyball spike game environment 10 generally includes a player 20, a ball 30, and a volleyball spike game 40. The ball 30 may be varying sizes, but commonly ranges from about 2.5 inches in diameter to about 8 inches in diameter. In this respect, the ball 30 may be smaller than a regulation volleyball (often just over eight inches in diameter), but as large or larger than a tennis ball. In the volleyball spike game environment 10, the player 20 bounces the ball 30 off a frame 100 that has an elastic cover 200. The frame 100 resembles that of a trampoline with the elastic cover 200 attached to the frame 100. The elastic cover 200 may be wrapped around, fastened to, or bonded with the frame 100. As a shape, the frame 100 may be circular, elliptical, rectangular, hexagonal, octagonal, or other polygonal shapes.

The elastic cover 200 generally refers to a game surface of the volleyball spike game 40 within the volleyball spike game environment 10. The elastic cover 200 has elastic properties to transfer the momentum of the ball 30 in another direction when the ball 30 contacts the elastic cover 200 (e.g., bounce the ball 30 off the elastic cover 200). A material and/or a tension of the elastic cover 200 may contribute to the elastic properties. Some materials for the elastic cover 200 include synthetic and/or natural fibers that may be woven and/or knit together. Additionally or alternatively, the material of the elastic cover 200 may form a mesh or an open fabric configuration. Depending on a manufacturing process and/or the materials chosen, these materials may be tightly or loosely woven and/or knit together. In other words, the elastic cover 200 may range from a mat-like material resembling a trampoline to an open mesh resembling a net. For simplicity of sight lines, FIGS. 1-2B and 4A-4D depict the elastic cover 200 within the volleyball spike game environment 10 as an open mesh surface (i.e. a tensioned net).

Figure 1B:
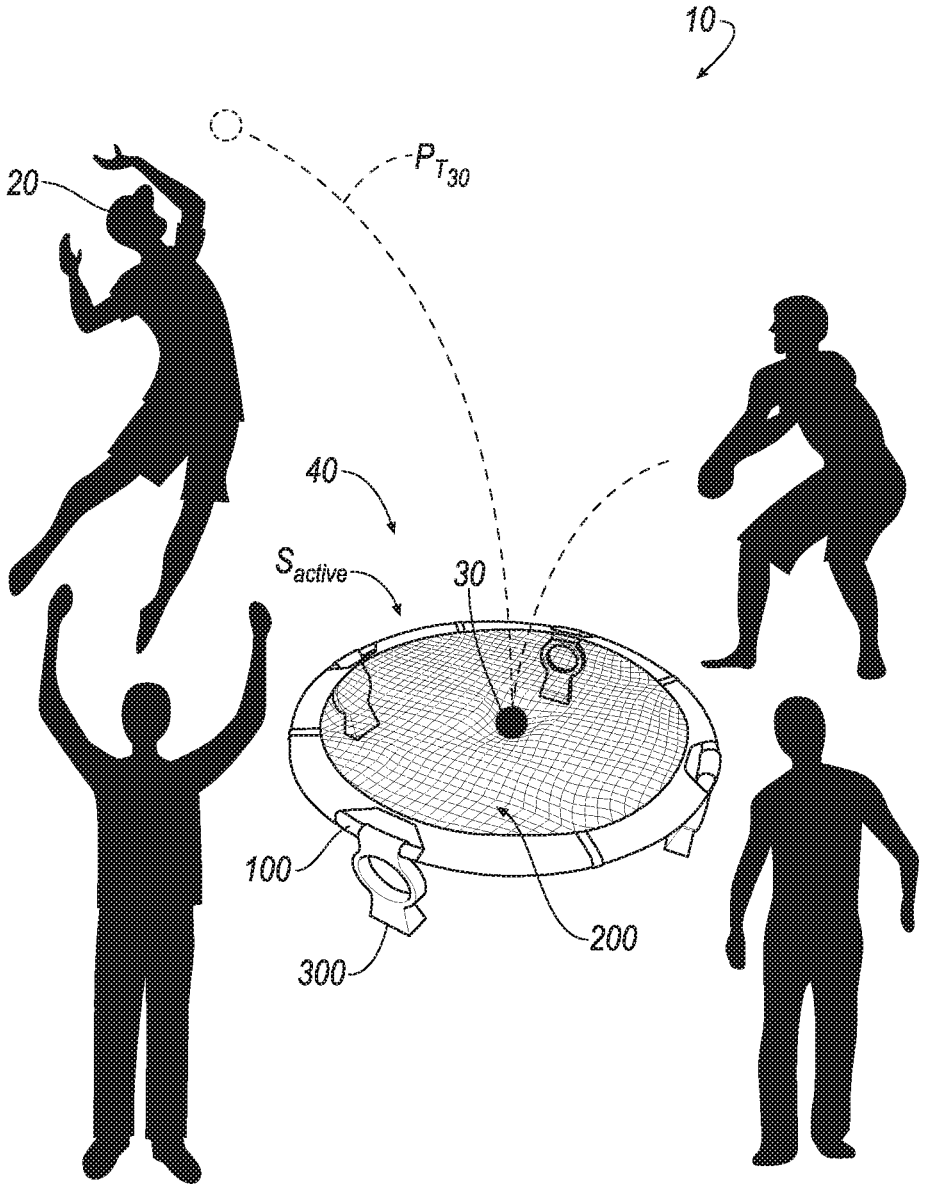
FIG. 1B is a perspective view of an example volleyball spike game environment.

The elastic cover 200 may have a resting state $S_{Rest}$ (e.g., FIG. 1A) and an active state $S_{Aactive}$ (e.g., FIG. 1B). In the resting state $S_{Rest}$, the elastic cover 200 is substantially planar. "Substantially" planar means that the elastic cover 200 may sag such that it is not absolutely planar when the elastic cover 200 is secured to the frame 100. For example, the securement of the elastic cover 200 to the frame 100 generates slack in the elastic cover 200 in the resting state $S_{Rest}$. This slack may occur when the elastic cover 200 is a highly elastic material (e.g., various elastomers) and therefore, does not necessarily need to be secured to the frame 100 with significant tension. In other examples, the elastic cover 200 is drawn taught by the securement of the elastic cover 200 to the frame 100 such that the elastic cover 200 approaches planarity. In the active state $S_{Aactive}$, the elastic cover 200 deforms according to the momentum of the ball 30. The deformation of the elastic cover 200 occurs in a direction of the path of travel $P_{T30}$ of the ball 30. Therefore, often the deformation occurs toward the ground or other surface underneath the at least one leg 300 and/or elastic cover 200.

At least one leg 300 supports the frame 100. In some examples, more than one leg 300 supports the frame 100. For example, FIGS. 1A-1B depicts four legs 300, 300*a-d* uniformly spaced around the frame 100 for support. The at least one leg 300 is configured to support the frame 100 such that the elastic cover 200 is offset from the ground or other surface underneath the at least one leg 300. The offset permits the elastic cover 200 to flex (e.g., bow or deform) toward the ground or the other surface when the ball 30 bounces off of the elastic cover 200. Each leg 300 may be permanently or temporarily (e.g., snap fit) attached to the frame 100. In some examples, each leg 300 has a designated position to attach to the frame 100. In other examples, the at least one leg 300 is movable to different positions along the frame 100. For example, in FIGS. 1A-1B, each leg 300 attaches to the frame 100 at a portion of the frame 100 absent the elastic cover 200. In another example, the at least one leg 300 attaches to the frame 100 by overlapping the elastic cover 200. For example, the at least one leg 300 may fasten to the frame 100 to provide securement of the elastic cover 200 to the frame 100.

In some configurations, the at least one leg 300 may be a single leg that extends downward from the frame 100 to the ground or other surface. As an example, when the frame 100 is circular, the single leg may be a circular strip that extends from the frame 100 to the ground. In some other examples, a single leg extends from a portion of the frame 100 to support the frame 100. For example, when a single leg supports a portion of the frame 100, another portion of the frame 100 rests on the ground such that, in the resting state $S_{Rest}$, the elastic cover 200 is at an angle formed by a height 300*h* of the single leg to the ground. These examples illustrate that the shape of the leg 300 and the number of legs 300 may vary to support the frame 100. In that respect, the leg 300 may vary by design preferences, aesthetics, frame configuration, a size of the ball 30 being retained, etc. For example, the shape of the leg 300 depicted in the figures, a circular middle portion with two thinner ends, is merely illustrative of features of the leg 300 and therefore the leg 300 may be many different configurations and/or shapes without departing from the spirit of the disclosure.

In some examples, each leg 300 of the at least one leg 300 is pivotably attached to the frame 100. The pivotable attachment enables the leg 300 to have a ground engaging state $S_{ground}$ (e.g., FIGS. 2A-2B) and a stowed state $S_{stowed}$ (e.g., FIGS. 4B-4C). In the ground engaging state $S_{ground}$, the leg 300 may be in an upright position or, alternatively, a position to support a force from the ball 30 striking the elastic cover 200 without the leg 300 collapsing. In the stowed state $S_{stowed}$, the leg 300 collapses such that it can no longer support a force from the ball 30 striking the elastic cover 200. As some examples, the leg 300 may fold under the elastic cover 200, fold over the elastic cover 200, or extend outward from the frame 100 at an angle greater than 90° from the elastic cover 200. Here, as illustrated by FIGS. 4B and 4C, the leg 300 may fold by pivoting about a frame receiving end 310. In some examples, when the leg 300 is in the stowed state $S_{stowed}$ the leg 300 is approximately parallel to the elastic cover 200. In some implementations, the leg 300 has approximately 90° of rotation between the ground engaging state $S_{ground}$ and the stowed state $S_{stowed}$. For example, when the leg 300 supports the frame 100 in an upright position (e.g., perpendicular to the ground), the leg 300 has approximately 90° of rotation between the ground engaging state $S_{ground}$ and the stowed state $S_{stowed}$. In some configurations, the leg 300 is capable of a rotation greater than 90°. With a rotation greater than 90°, the leg 300, in the ground engaging state $S_{ground}$, may form an acute angle with the ground or support surface. Additionally or alternatively, with a rotation greater than 90°, the leg 300 may, in the stowed state $S_{stowed}$, have more than one stowed position. For example, when the leg 300 has a rotation capable of at least 180°, the leg 300 may have a stowed position at zero degrees and 180° with respect to the elastic cover 200.

In some implementations, the at least one leg 300 has a front side 302, a rear side 304, and an inner wall 306 defining an opening 308 in the leg 300. When the leg 300 is in the ground engaging state $S_{ground}$, the front side 302 of the leg 300 generally faces away from the elastic cover 200. In the same state, the rear side 304 generally faces toward the elastic cover 200.

The leg 300 additionally includes the frame receiving end 310, a ground engaging end 320, and a middle portion 330. The frame receiving end 310 is configured to attach to the frame 100 or to a portion of the frame 100. The frame receiving end 310, for example, may snap fit, clip, or rest over the frame 100. In other examples, the frame receiving end 310 is positioned on the frame 100 during manufacturing and/or assembly before the frame 100 is secured together such that the leg 300 cannot be removed without separating the frame 100. In some implementations, the leg 300 pivots at the frame receiving end 310 to define a pivotable frame receiving end.

To attach to the frame 100, the frame receiving end 310 may include a frame receiving end opening 316 extending from a distal side 312 of the frame receiving end 310 to the proximal side 314 of the frame receiving end 310. The frame receiving end 310 includes a frame receiving end opening axis $A_{316}$ centered within the frame receiving end opening 316 and extending in along a length of the frame receiving end opening 316. In some implementations, the leg 300 pivots at the frame receiving end 310 about the frame receiving end opening axis $A_{316}$ between the ground engaging state $S_{ground}$ and the stowed state $S_{stowed}$. In some examples, a length 316*l* of the frame receiving end opening 316 corresponds to a width 300*w* of the leg 300. In other examples, the length 316*l* of the frame receiving end opening 316 is a design parameter that is varied for aesthetic reasons and/or various frame 100 configurations.

Referring to FIGS. 2A-3D, the frame 100 may have a curved frame member where the leg 300 attaches to the frame 100. At this location, the frame receiving end opening 316 corresponds to a curvature of the frame 100. For example, the frame receiving end opening 316 has a radius of curvature $R_{316}$ operable to receive the curved frame member. In other words, a radius of curvature $R_{frame}$ of the curved frame member may equal or be within a fit tolerance of the radius of curvature $R_{316}$ of the frame receiving end opening 316.

Figure 2A:
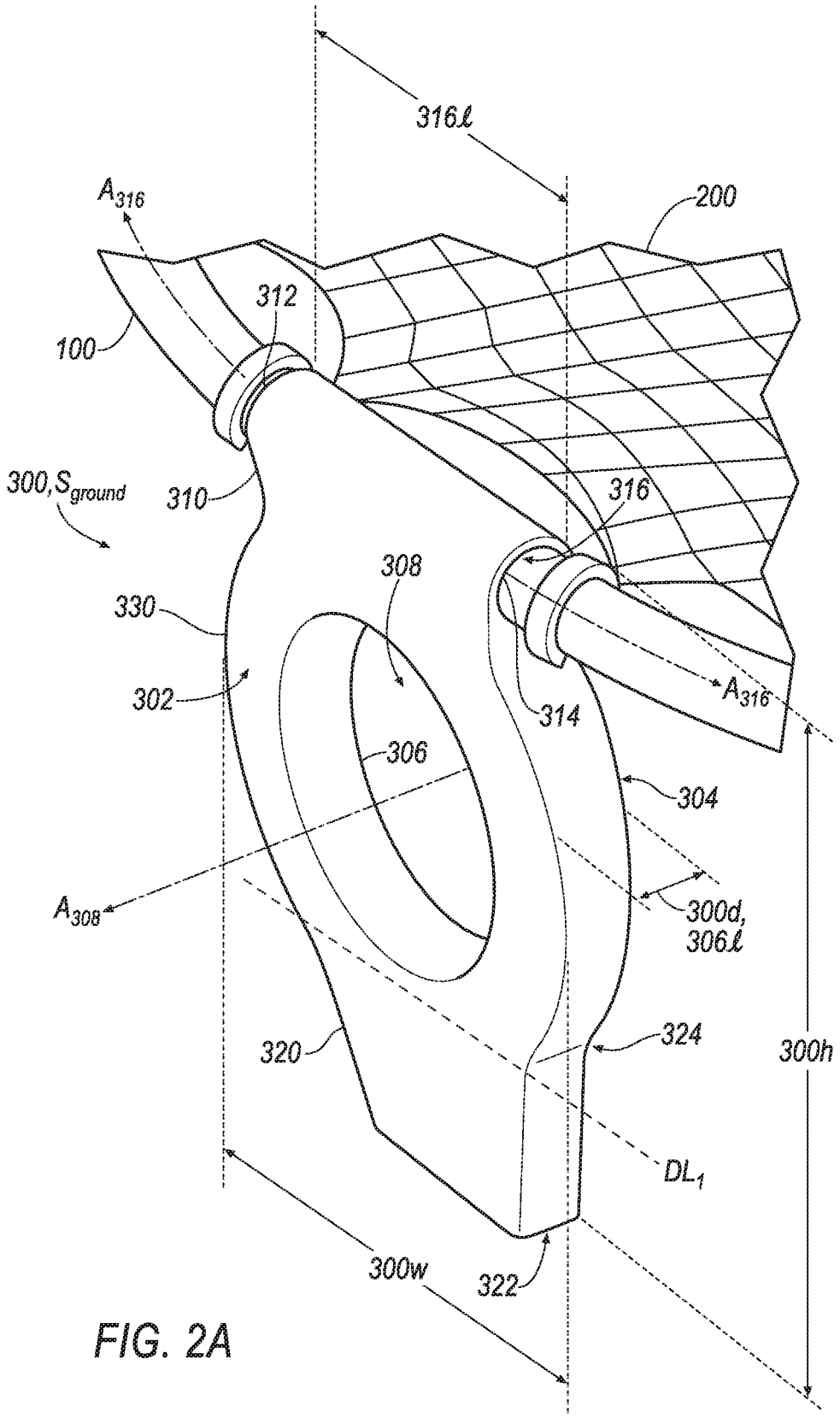
FIGS. 2A and 2B are perspective views of example legs of a volleyball spike game.
Figure 2B:
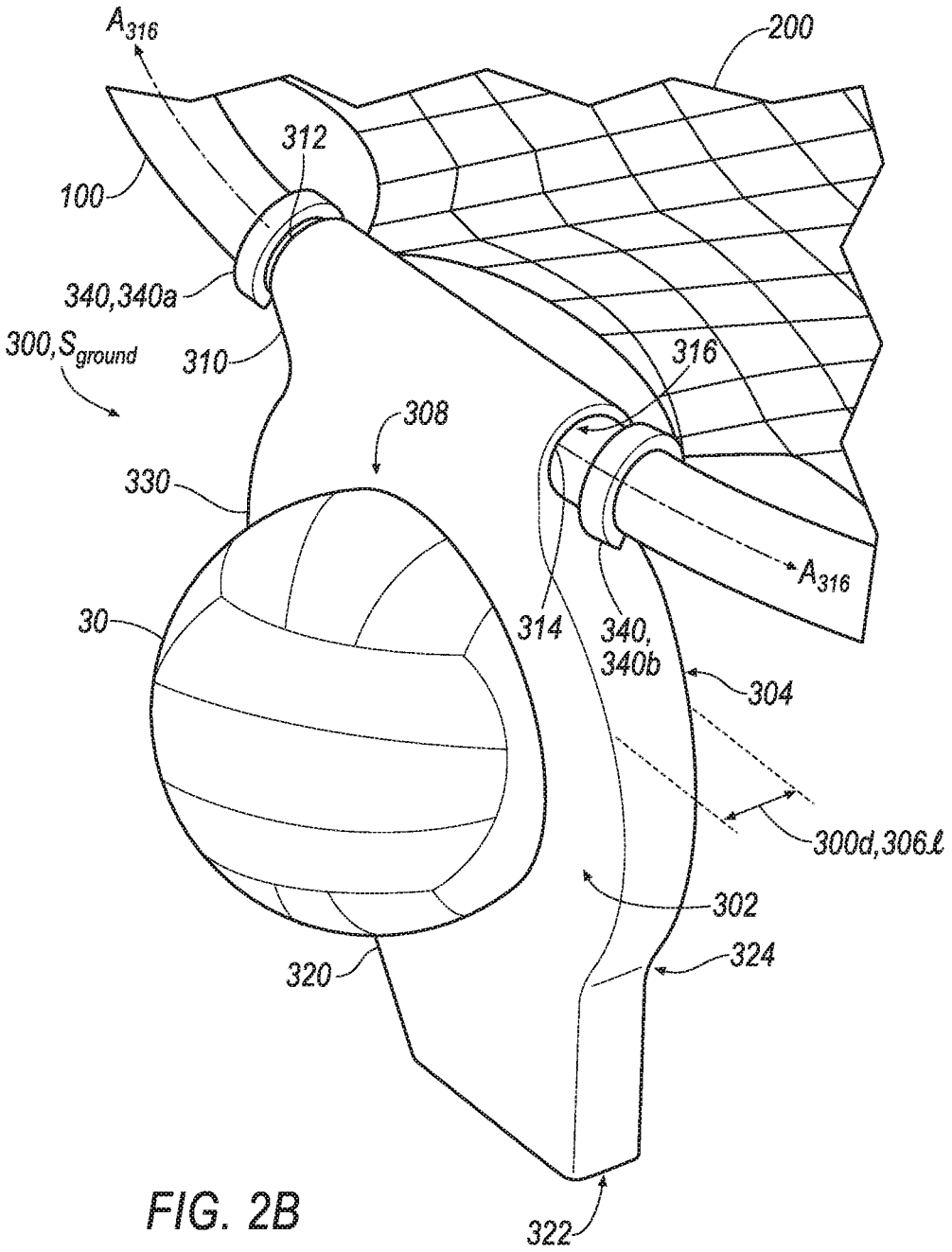

Referring further to FIGS. 2A-2B, the ground engaging end 320 has a ground engaging surface 322 that maintains contact with a ground plane or other surface (e.g., a deck, floor, carpet, patio, driveway, etc.) when the leg 300 is in the ground engaging state $S_{ground}$. In some examples, the ground engaging surface 322 is angled with respect to the front side 302. For example, in the ground engaging state $S_{ground}$, the ground engaging surface 322 and the front side 302 form an acute angle. In some implementations, the ground engaging end 320 begins beneath (i.e. towards the ground or other surface) the opening 308 of the leg 300. For example, FIGS. 2A-2B depict that the ground engaging end 320 begins as a cylindrically shaped middle portion 330 transitions (e.g., tapers) to a rectangular portion of the leg 300. FIG. 2A illustrates the transition point 324 from the middle portion 330 to the ground engaging end 320 along or near the imaginary dividing line $DL_1$. Although the figures illustrate the ground engaging end 320 as rectangular, the ground engaging end 320 may be any shape suitable to support the force of the ball 30 striking the elastic cover 200 without collapsing.

FIG. 2B is an example depicting the leg 300 configured to retain the ball 30. The leg 300 retains the ball 30 by the ball 30 fitting within the inner wall 306 of the leg 300 such that at least part of the ball 30 occupies the opening 308. The leg 300 has a depth 300*d* extending from the front side 302 to the rear side 304 that may correspond to a length 306*l* of the inner wall 306. In some examples, the length 306*l* and a surface area of the inner wall 306 allow a friction fit and/or pressure fit with the ball 30. In other examples, a diameter 308*d* of the opening 308 formed by the inner wall 306 allows the ball 30 to rest within the opening 308 without a pressure fit. In some implementations, the inner wall 306 tapers (shown in FIGS. 3A-3B) from the front side 302 to the rear side 304 in order to conform to an outer surface of the ball 30. By conforming to the outer surface of the ball 30, the inner wall 306 with the taper may retain the ball 30 better than a design with a straight inner wall 306.

The opening 308 has an opening axis $A_{308}$ centered within the opening 308 and extending in along a length of the opening 308. In some implementations, in the ground engaging state $S_{ground}$, the opening axis $A_{308}$ is perpendicular to the frame receiving end opening axis $A_{316}$. For example, when the ground engaging end 320 is at a right angle (i.e. perpendicular to the ground or other surface), the opening axis $A_{308}$ is perpendicular to the frame receiving end opening axis $A_{316}$. In other examples, the opening axis $A_{308}$ and the frame receiving end opening axis $A_{316}$ are parallel. In these examples, the front side 302 and the rear side 304 correspond to the distal side 312 and the proximal side 314. Practically speaking, this means the leg 300 having the opening 308 may be rotated 90 degrees from the depictions in FIGS. 2A-2B and still be within a spirit of the disclosure.

Additionally or alternatively, the leg 300 may be constrained in position within the volleyball spike game 40 by guides 340. The guides 340 constrain the at least one leg 300 at a set position along the frame 100. As an example, FIGS. 2A-2B illustrate two guides 340, 340*a-b*. A first guide 340*a* is adjacent to the leg 300 at the distal side 312 of the frame receiving end 310 and a second guide 340*b* is adjacent to the leg 300 at the proximal side 314 of the frame receiving end 310. In some examples, the guides 340, 340*a-b* have some tolerance or may be offset from the frame receiving end 310 such that the leg 300 may move a finite distance between the guides 340, 340*a-b*.

Figure 3B:
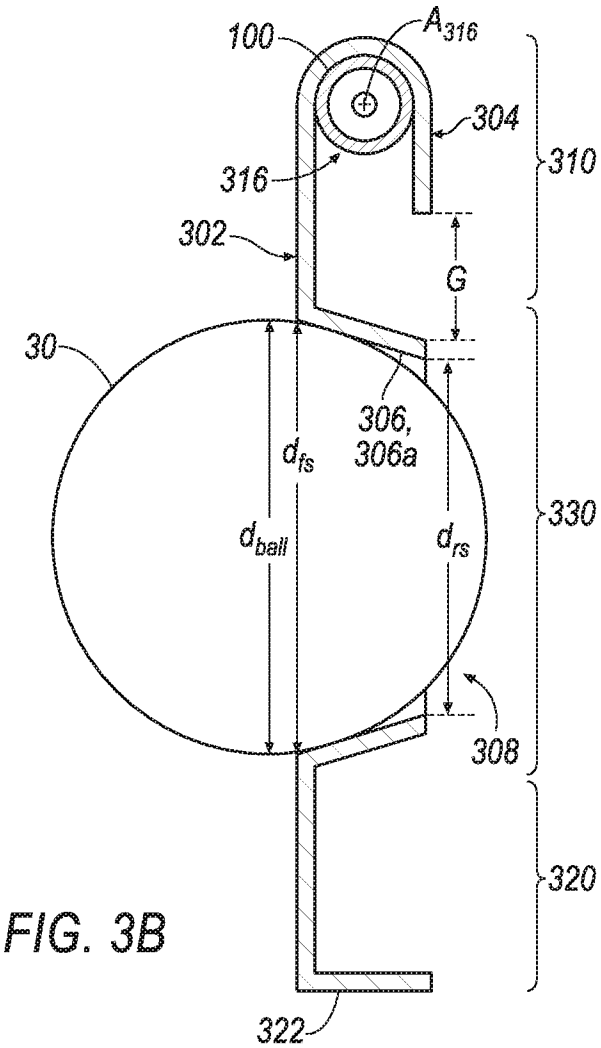
FIGS. 3A-3D are cross sectional views of examples of a leg of the volleyball spike game.
Figure 3A:
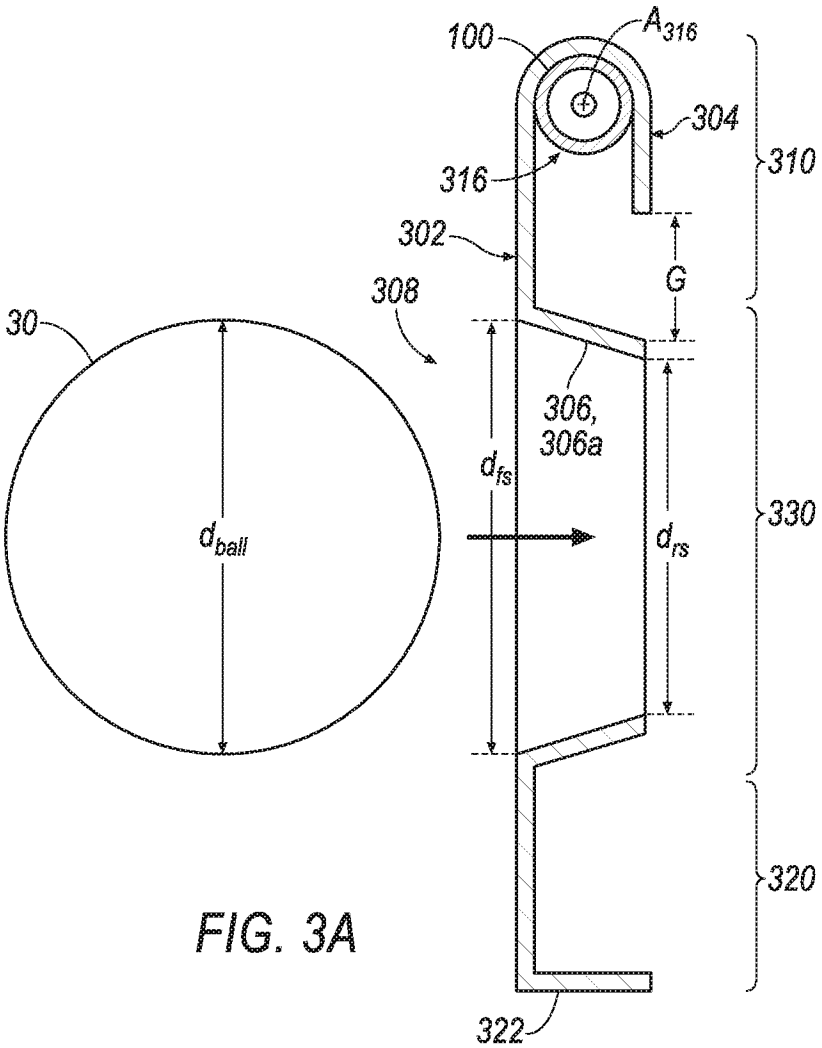

FIGS. 3A-3D are examples of the leg 300 according to cross sectionals views that show how the ball 30 fits into the opening 308 of the leg 300. FIG. 3A illustrates the leg 300 before receiving the ball 30. An arrow indicates a movement vector of the ball 30 into the leg 300 in order to define how FIGS. 3B-3D receive the ball 30. Here, portions of the outer surface of the ball 30 contact the inner wall 306. As previously mentioned, the contact with the ball 30 and the inner wall 306 may form a friction fit, a pressure fit, or simply allow the ball 30 to rest in a position within the opening 308. FIGS. 3A-3D also depict that the frame 100 may have a circular cross section that is received by the frame receiving end opening 316 and that the ground engaging surface 322 of the ground engaging end 320 supports the frame 100 by extending at a right angle from the front side 302.

Figure 3D:
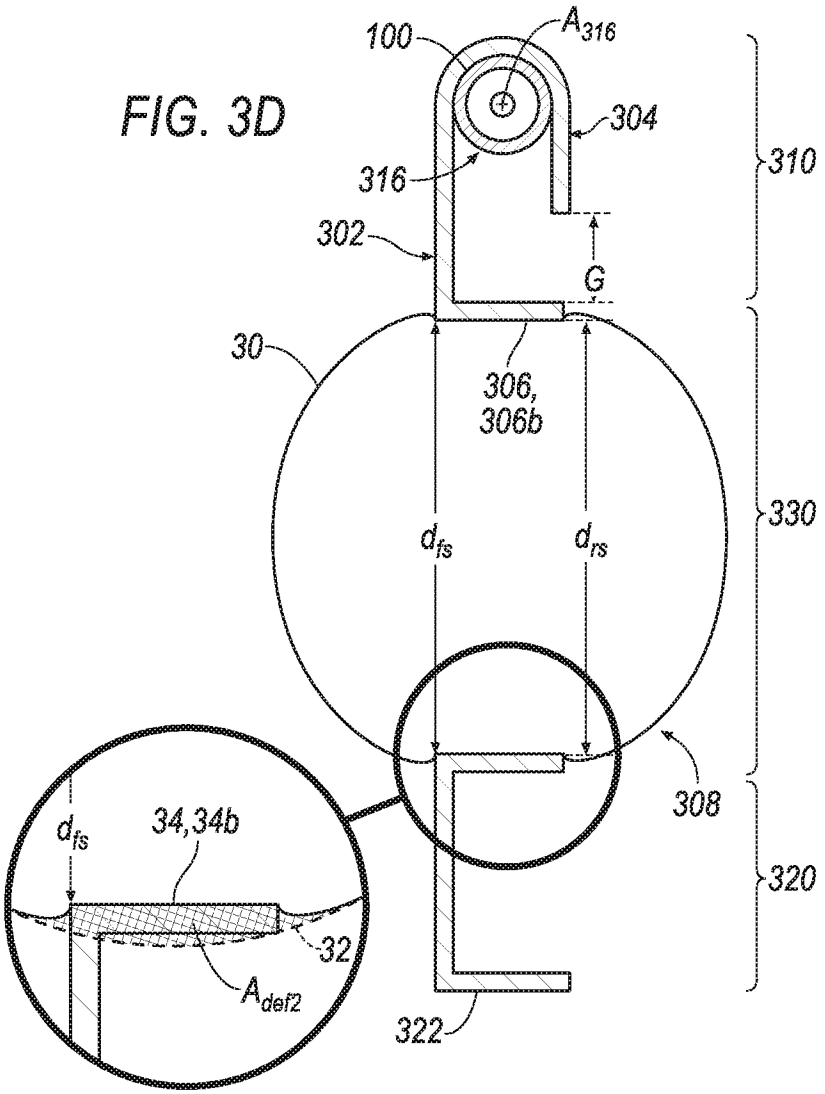
Figure 3C:
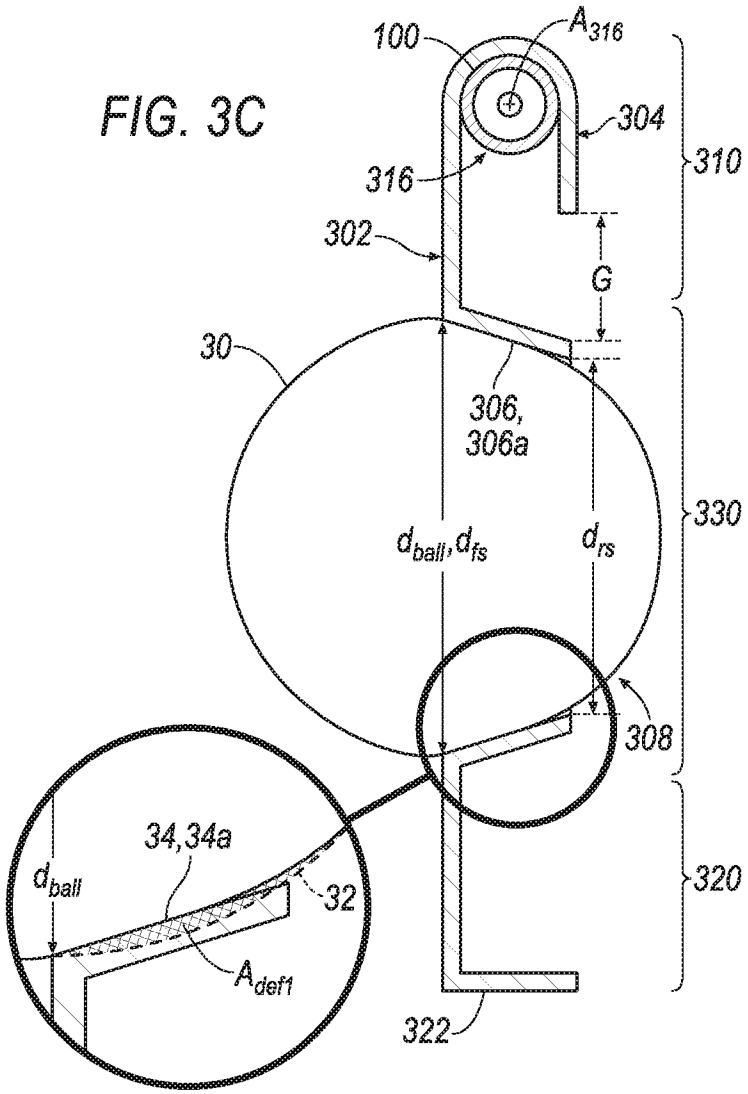

Referring further to FIGS. 3A-3C, these figures depict the inner wall 306 tapering from the front side 302 to the rear side 304. The tapering defined by a diameter $d_{fs}$ of the inner wall 306 at the front side 302 that is greater than the diameter $d_{rs}$ of the inner wall 306 at the rear side 304. In some implementations, the tapering of the inner wall 306 has a structure with a diameter $d_{rs}$ at the rear side 304 less than a diameter $d_{ball}$ of the ball 30. The tapering of the inner wall 306 may form a frustoconical ring. An advantage of the tapering is that the inner wall 306 may have a greater contact surface area with the ball 30.

In some examples, the ball 30 is compressed into the opening 308 within the leg 300. FIGS. 3B-3D represent different configurations of the inner wall 306. FIG. 3B is an example of a tapered inner wall 306, 306*a*. FIG. 3B illustrates a friction fit where the ball 30 is held in place within the opening 308 by friction between the outer surface of the ball 30 and the tapered inner wall 306, 306*a*. FIG. 3C is an example of a tapered inner wall 306, 306*c* similar to FIG. 3B except that the tapered inner wall 306, 306*c* also holds the ball 30 in place by an interference between the diameter (e.g., $d_{fs}$ and $d_{rs}$) of the tapered inner wall 306, 306*b* and the diameter $d_{ball}$ of the ball 30. FIG. 3D is an example of a straight inner wall 306, 306*b*. FIG. 3D illustrates a pressure fit where the ball 30 is held in place within the opening 308 by some combination of friction between the outer surface of the ball 30 and the straight inner wall 306, 306*b* and pressure from an interference between the diameter d of the straight inner wall 306, 306*b* and the diameter $d_{ball}$ of the ball 30. In these examples, the compression caused by the interference of the ball 30 and the inner wall 306 may form a flat portion of the ball 30 along the outer surface of the ball 30. As comparative illustrations, FIG. 3B depicts the ball 30 predominantly resting within the inner wall 306 of the leg 300 with minimal deformation; while, FIG. 3C depicts a greater pressure fit than FIG. 3B such that the pressure fit of the ball 30 within the leg 300 deforms an arcuate section 32 of the outer surface of the ball 30 into a flat portion 34. In other words, at points of contact with the tapered inner wall 306, 306*a*, the outer surface of the ball 30 flattens into a cord 34, 34*a* corresponding to a circumference of the ball 30. FIGS. 3B and 3C depict that a degree of tapering (i.e. related to a slope of the diameter $d_{fs}$ at the front side 302 and the diameter $d_{rs}$ at the rear side 304) of the inner wall 306 may vary the compression of the ball 30 within the opening 308.

Comparing FIGS. 3C and 3D, the tapered inner wall 306, 306*a* may deform the ball 30 less than the straight inner wall 306, 306*b*. As previously stated, the tapered inner wall 306, 306*a* deforms the ball 30 into a cord 34, 34*a* along the outer surface of the ball 30; while, the straight inner wall 306, 306*b* deforms the ball 30 into a partial segment 34, 34*b* along the outer surface of the ball 30. In these examples, an inner wall 306 tailored to the diameter $d_{ball}$ of the ball 30 may reduce and/or may prevent deformation of the ball 30 over time as the ball 30 is retained within the leg 300. FIGS. 3C and 3D are examples where the tapered inner wall 306, 306*a* reduces the deformation of the ball 30 as compared to the straight inner wall 306, 306*b*. To illustrate, a first deformed area $\Delta_{def1}$ of the ball 30 with the tapered inner wall 306, 306*a* of FIG. 3C is shown as having an area less than a second deformed area $A_{def2}$ of the ball 30 with the straight inner wall 306, 306*b* of FIG. 3D. In other words, the tapered inner wall 306, 306*a* of FIG. 3C does not stress the ball 30 as much as the straight inner wall 306, 306*b* of FIG. 3D during retention of the ball 30 within the leg 300.

In some examples, the rear side 304 includes a gap G such that the frame 100 may be received by the leg 300. For example, FIGS. 3A-3D depict the leg having the gap G larger than a diameter of the frame 100 such that the frame 100 is received within the gap G and positioned within the frame receiving end opening 316. This gap G may permit the leg 300 to be removable from the frame 100 for adjustment or for storage of the leg 300.

Figure 4A:
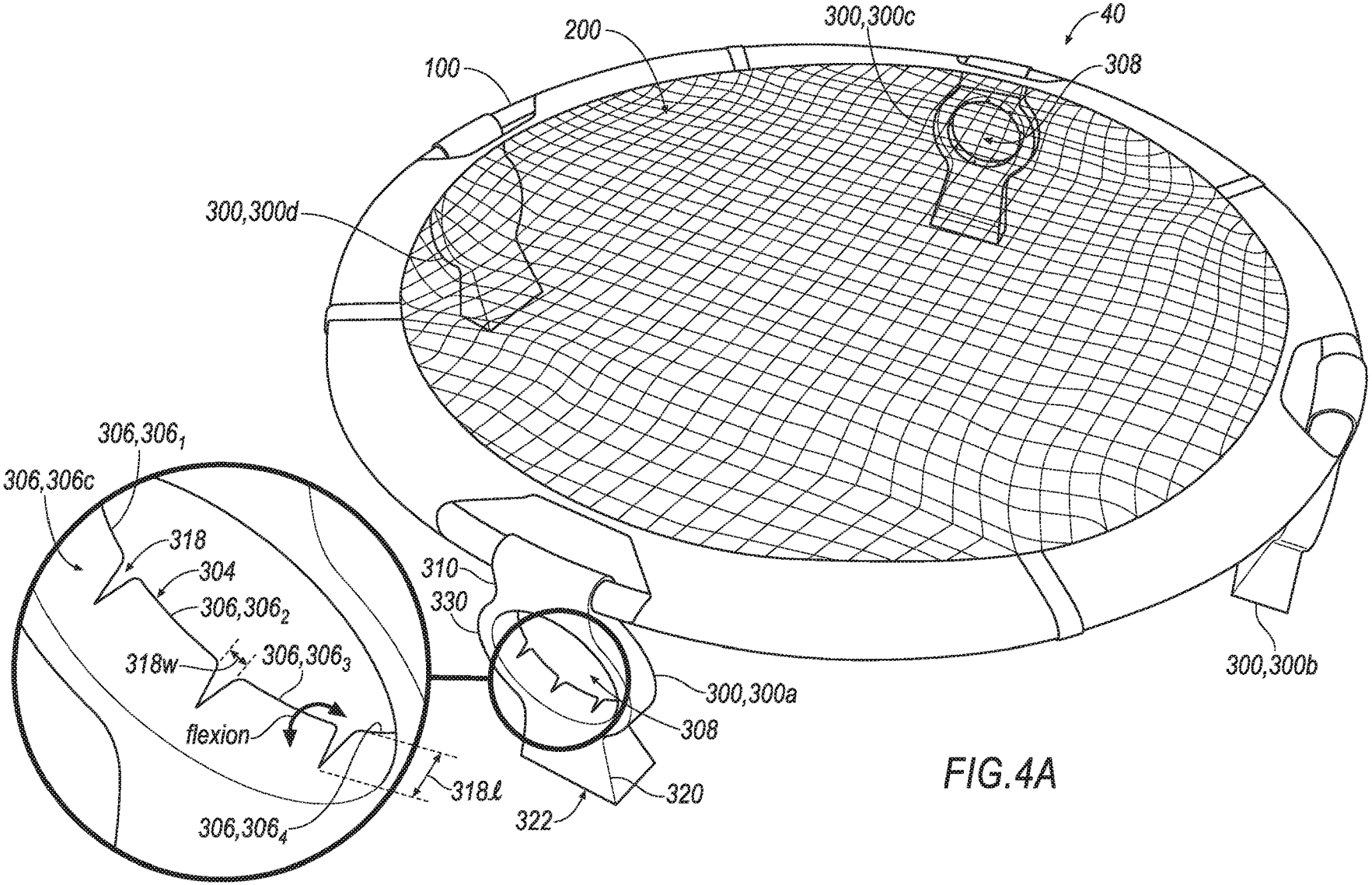
FIG. 4A is a perspective view of an example volleyball spike game with supporting legs along with an enlarged view of a portion of a leg of the volleyball spike game.
Figure 4B:
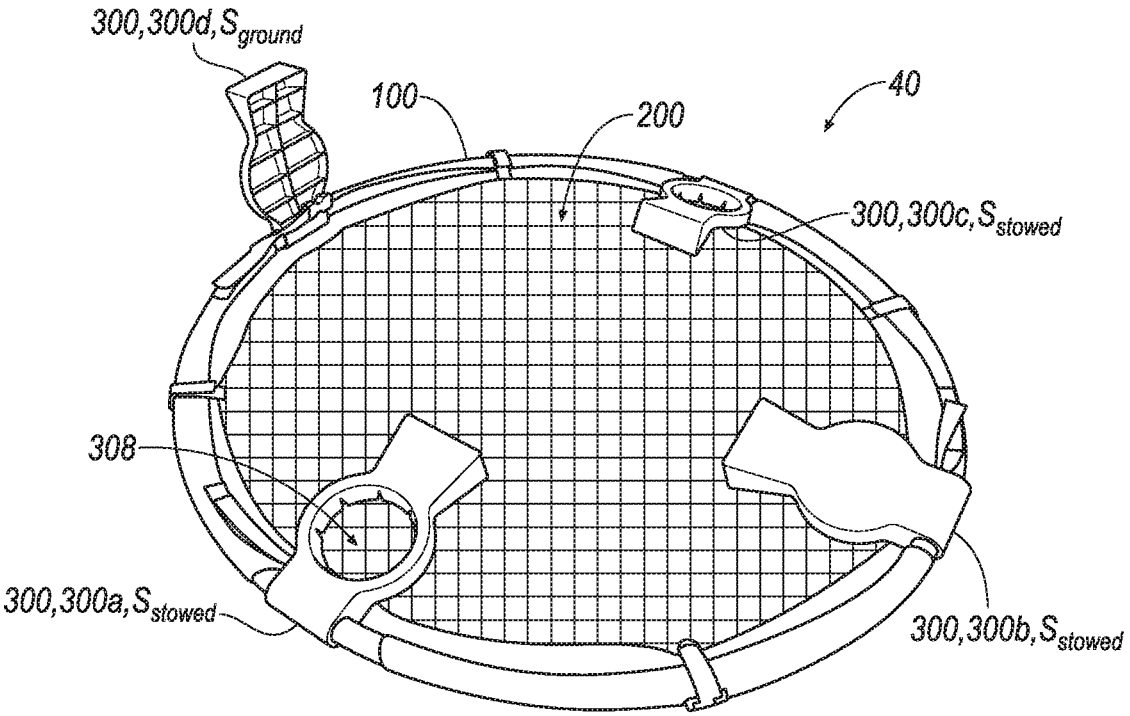
FIG. 4B is a perspective view of a volleyball spike game with legs between a ground engaging state and a stowed state.
Figure 4C:
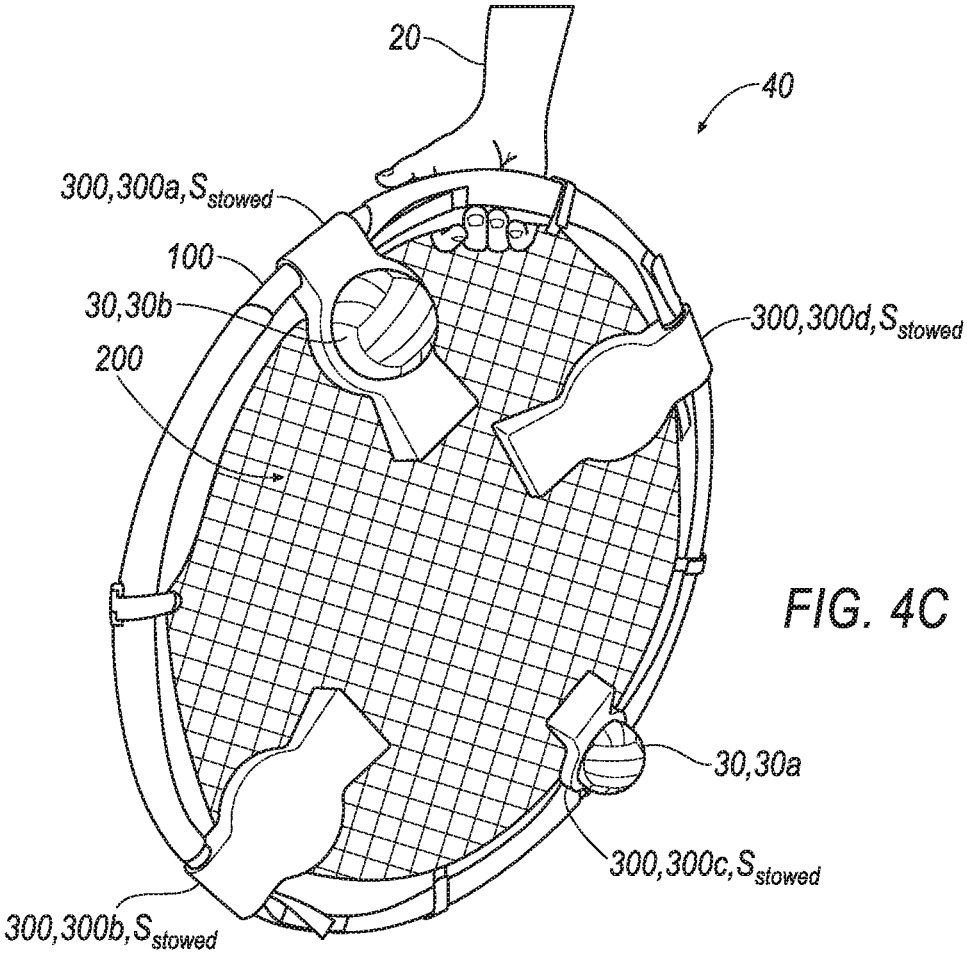
FIG. 4C is a perspective view of a volleyball spike game with legs in a stowed state.

FIG. 4A is an example of the volleyball spike game 40 having a leg 300 with a slitted inner wall 306, 306*c*. In some examples, each slit 318 extends from the rear side 304 towards to front side 302. In some implementations, each slit 318 is generally V-shaped such that the slit 310 has a greater width 318*w* at the rear side 304 than near the front side 302. Alternatively, each slit 318 may have other shapes besides a V-shape, such as a U-shape, C-shape, or slotted shape. An advantage of the slitted inner wall 306, 306*c* is that each slit 318 permits a degree of flexion of the inner wall 306 during receipt of the ball 30. The flexion may allow the inner wall 306 to grip into the ball 30 at each portion $\mathbf{306}_{(1\text{-}n)}$ of the inner wall 306 separated by each slit 318. In other words, each portion $\mathbf{306}_{(1\text{-}n)}$ of the inner wall 306 separated by each slit 318 acts like teeth to clasp the ball 30.

Another advantage is that the flexion allows the inner wall 306 of the leg 300 to adapt to balls 30 of different hardness/firmness. For example, the inner wall 306 may experience greater stress from the hardness of a plastic ball compared to a rubber ball. In the case of a rubber ball, the inner wall 306 may not need to compensate for the stress from the outer surface of the rubber ball. In contrast, the hardness of a plastic ball may stress the inner wall 306 such that the inner wall 306 may crack or break under stress over time. To prevent this failure (e.g., cracking or breaking), each slit 318 permits the inner wall 306 to flex to compensate for the stress from the hardness of the ball 30. Therefore, in this example for a plastic ball, each portion $\mathbf{306}_{(1\text{-}n)}$ of the inner wall 306 flexes away from the opening 308 under stress from the hardness. In other words, each portion $\mathbf{306}_{(1\text{-}n)}$ of the inner wall 306 is independently flexible from each other portion $\mathbf{306}_{(1\text{-}n)}$ of the inner wall 306 due to each slit 318 separating portions $\mathbf{306}_{(1\text{-}n)}$. For example, FIG. 4A depicts a closeup of the slitted inner wall 306, 306*c* that shows four portions 306, $\mathbf{306}_{(1\text{-}4)}$. Within the closeup, an arched arrow indicates a degree of flexion for each portion $\mathbf{306}_{(1\text{-}n)}$ of the slitted inner wall 306, 306*c*. The degree of flexion depends on a material composition of the slitted inner wall 306, 306*c* and/or a length 318*l* of each slit 318. For example, a longer slit 318 may have greater flexion than a shorter slit 318.

FIG. 4A is also an example that the volleyball spike game 40 may include some legs 300 with the opening 308 and other legs without the opening 308. For example, FIG. 4A depicts two legs 300 with the opening 308 and two legs without the opening 308. This depicted configuration may store up to two balls 30. Configurations may vary depending on the number of balls 30 a player 20 wants to store and/or the number of legs 300 included with the volleyball spike game 40 such that any combination of legs 300 with and without openings 308 is possible.

FIGS. 4B and 4C are examples of the stowed state $S_{stowed}$ of the leg 300 within the volleyball spike game environment 10. FIG. 4B depicts the underside of the frame 100 such that the volleyball spike game 40 rests on the elastic cover 200 to illustrate each leg 300. Here, there are four legs 300 configured to support the frame 100. The first leg 300, 300*a* without the opening is within the ground engaging state $S_{ground}$. The other three legs 300, 300*b-d* have pivoted toward a center of the elastic cover 200 such that each of these three legs 300, 300*b-d* are at an angle less than 90 degrees with respect to the elastic cover 200. In some examples, a leg 300 may be in the stowed state $S_{stowed}$ and approximately parallel to the elastic cover 200. "Approximately" here means that the securement of the elastic cover 200 and/or shape of the leg 300 with the ball 30 may prevent the leg 300 in the stowed state $S_{stowed}$ from reaching absolute parallelism to the elastic cover 200. Therefore, the leg 300 is approximately parallel when an angle between the elastic cover 200 and the leg 300 approaches zero degrees. In FIG. 4B, none of the legs 300, 300*a*-d include the ball 30. FIG. 4C depicts each of the legs 300, 300*a-d* in the stowed state $S_{stowed}$ while also incorporating two balls 30, 30*a-b* in each of the legs 300 with the opening 308. In some implementations, each leg 300 may be designed such that the leg 300, in the stowed state $S_{stowed}$, may pivot underneath the elastic cover 200 or on top of the elastic cover 200.

As illustrated by FIG. 4C, an advantage of the disclosure is that a player 20 may transport and/or store the volleyball spike game 40 with all its components at one time. This all-inclusive design may prevent a component like the ball 30 from being lost or forgotten during transport and/or storage. Additionally or alternatively, the design may permit a player to carry the volleyball spike game one-handed such that the player 20 may have his/her second hand free.

FIGS. 5A-8E are examples that illustrate an assembly process of the volleyball spike game 40. The assembly process includes a frame assembly process 500 and an elastic cover assembly process 600. Moreover, the elastic cover assembly process 600 may further include an elastic cover securement process 700 and/or an elastic cover tensioning process 800. A purchaser (e.g., a player 20) may receive the volleyball spike game 40 assembled, partially assembled, or requiring assembly. For example, the purchaser 20 receives the game with the frame 100 constructed, but the elastic cover 200 unsecured to the frame 100 and requiring the elastic cover assembly process 600 to play volleyball spike game 40.

In some configurations, such as FIGS. 5A-5G, the frame 100 includes one or more subcomponents (e.g., sub-frames 110, 110*a-d*). With more than one sub-frame 110, the frame 100 may be assembled by a frame assembly process 500. As an example, FIGS. 5A-5G illustrate a frame assembly process 500 with more than one operation 510 (e.g., operations 510, 510*a-g*) to construct the frame 100. Here, each sub-frame 110 is an arcuate shaped tube to form an elliptical or generally circular frame 100. Yet in other examples, to form the shape of the frame 100, the sub-frame 110 may vary in shape and/or number for aesthetic and/or design purposes. For simplicity, the frame assembly process 500 with operations 510*a-g* shows four sub-frames 110, 110*a-d* each forming approximately one-quarter of the frame 100. Although FIGS. 5A-5G depict the frame 100 being constructed with subcomponents in more than one operation 510 (e.g., sub-frames 110), the frame 100 may be assembled by a single operation 510. Alternatively, there may be instances when the frame 100 does not require assembly (e.g., the frame 100 is a unitary structure).

FIGS. 5A-5G are examples where the frame assembly process 500 integrates each leg 300 into the assembly operations 510*a-g*. For illustration, each operation 510 corresponds to an attachment of either a sub-frame 110 (FIGS. 5A, 5B, 5D, 5F) or a leg 300 (FIGS. 5C, 5E, and 5G) during the frame assembly process 500. In these examples, each sub-frame 110, 110*a-d* includes a distal end 112, 112*a-d* and a proximal end 114, 114*a-d*. Either or both ends of the distal end 112 or the proximal end 114 may include a connector or interlocking means (e.g., a female connector on one end and a male connector on the opposite end). Here, the term connector or interlocking means refers to a structural formation about an end of the sub-frame that engages (e.g., snap fit, friction fit, magnetic fit, etc.) with a second component (e.g., a leg 300 or another sub-frame 110) to secure a respective end of the sub-frame 110 with the connector or the interlocking means in a fixed position. In some instances, the connector or interlocking means is bi-directional such that it may be both engaged and disengaged without permanent deformation to the sub-frame 110.

Referring to FIGS. 5A-5G, the proximal end 114 includes a slotted connector where a slot is formed in the sub-frame 110. Here, the slotted connector is an open-slotted connector extending from a terminating end of the proximal end 114 towards the distal end 112. At the distal end 112, the sub-frame 110 includes a tenon-like projection and a slotted connector. In some examples, the projection includes features (e.g., rib(s)) and/or a key to enable the distal end 112 to maintain a fixed position once assembled. For example, a keyed connector may be received along a channel (or groove) where the channel has a geometry corresponding to the key. An example of a keyed connector is a twist lock connector where at a position within the channel, the channel diverges from a first direction to a second direction (i.e. a twist lock direction) such that walls of the channel along the second direction interfere with a directional force acting on a component with the twist lock connector unless the directional force tracks the directions of the channel. In some configurations, the proximal end 114 and/or the distal end 112 may include a single interlocking means (e.g., the proximal end 114 of FIGS. 5A-5G), multiple interlocking means (e.g., the distal end 112 of FIGS. 5A-5G), or no interlocking means (e.g., one end overlaps another end).

Figure 5A:
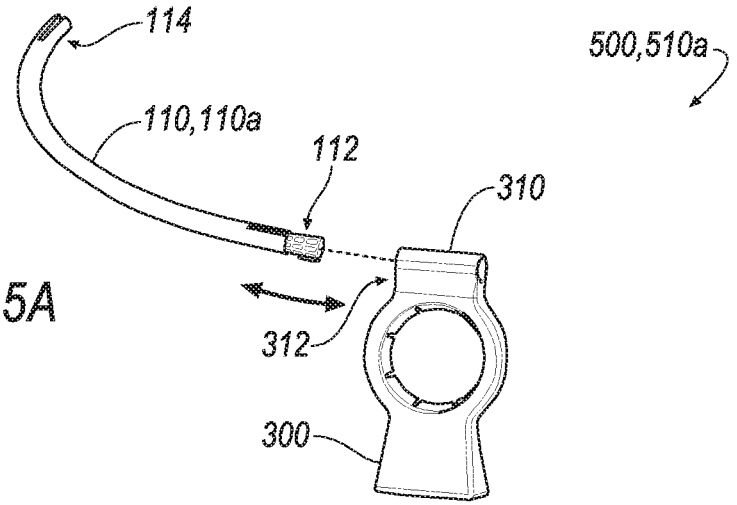
FIGS. 5A-5G are perspective views of operations for a frame assembly process.
Figure 5B:
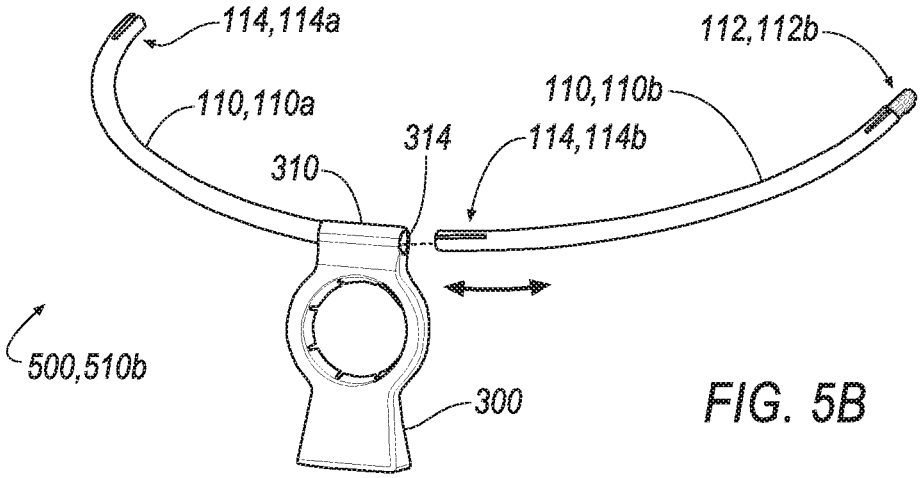
Figure 5C:
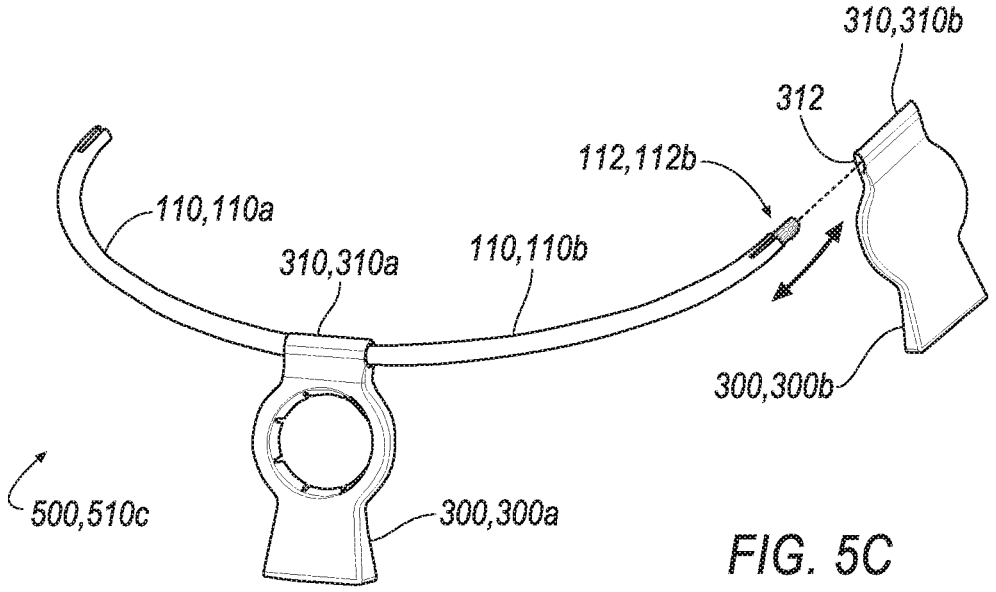
Figure 5D:
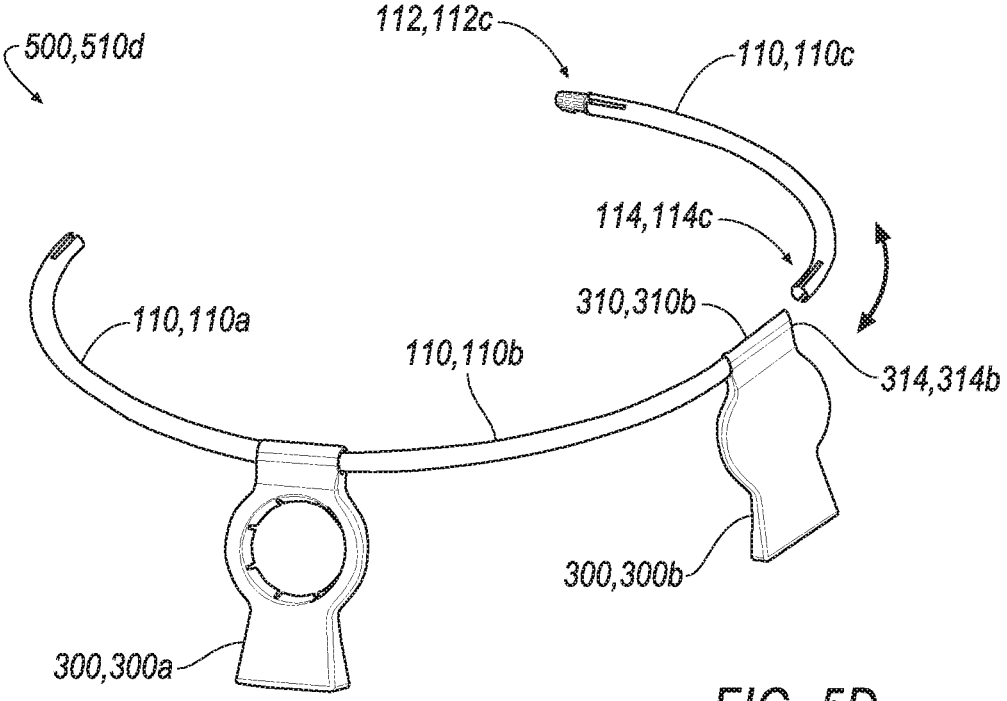
Figure 5E:
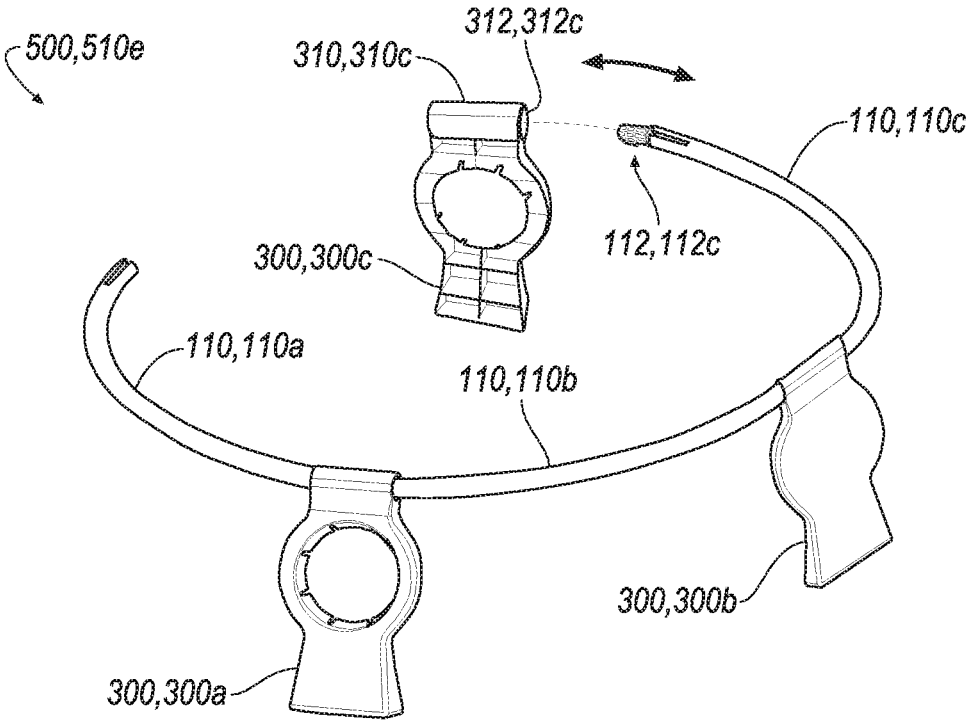
Figure 5F:
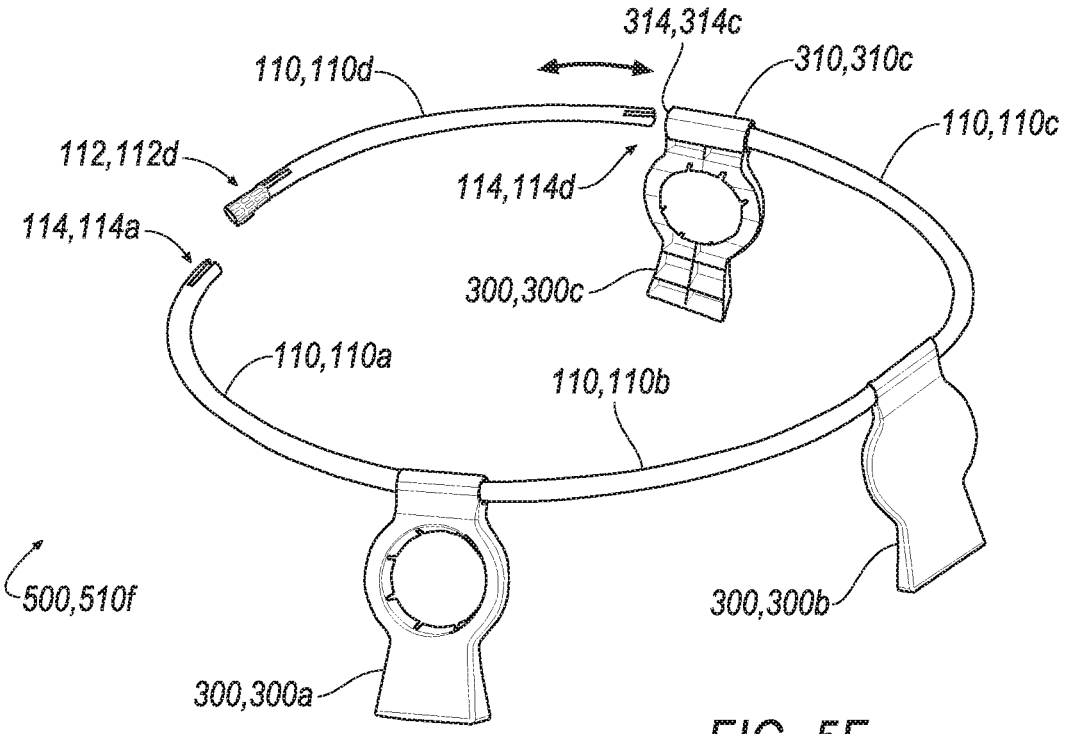
Figure 5G:
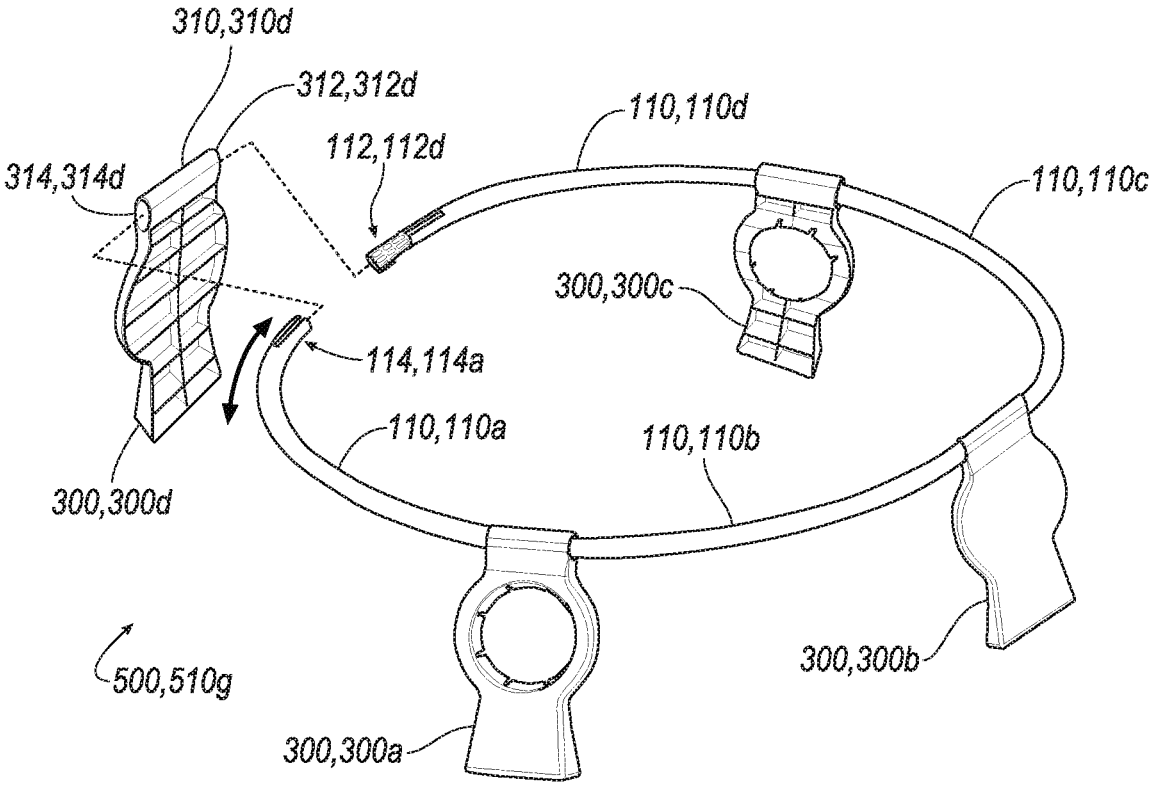

When each leg 300 (e.g., legs 300, 300*a-d*) receives each sub-frame 110 (or vice versa), the distal side 312 (e.g., distal sides 312, 312*a-d*) of the frame receiving end 310 (e.g., frame receiving ends 310, 310*a-d*) of the leg 300 receives the distal end 112 of the sub-frame 110. While, the proximal side 314 of the frame receiving end 310 of the leg 300 receives the proximal end 114 of the sub-frame 110. For example, FIGS. 5A, 5C, and 5E illustrate, at operations 510, 510*a*, 510*c*, 510*e*, a leg 300 (e.g., shown as a first leg 300*a*, a second leg 300*b*, or a third leg 300*c*) receives a distal end 112 of a sub-frame 110 (e.g., shown as a first sub-frame 110*a*, a second sub-frame 110*b*, or a third sub-frame 110*c*) at the distal side 312 of the frame receiving end 310. In other examples, such as FIGS. 5B, 5D, and 5F, a leg 300 (e.g., shown as the first leg 300*a*, the second leg 300*b*, and the third leg 300*c*) receives a proximal end 114 of a sub-frame 110 (e.g., shown as the second sub-frame 110*b*, the third sub-frame 110*c*, and a fourth sub-frame 110*d*) at the proximal side 314 of the frame receiving end 310. As shown by FIGS. 5A-5F, operations 510, 510*a-f* incrementally construct the frame 100 until operation 510, 510*g* completes construction of the frame 100. For instance, FIG. 5G shows, at operation 510, 510*g*, a fourth leg 300, 300*d* receives the proximal end 114 of the first sub-frame 110, 110*a* at the proximal side 314 and also receives the distal end 112 of the fourth sub-frame 110, 110*d* at the distal side 312 of the frame receiving end 310. Throughout FIGS. 5A-5G, arrows indicate an assembly direction that each leg 300 and/or each sub-frame may travel during a respective operation 510.

In some configurations, when a leg 300 receives both a first sub-frame 110*a* at the distal side 312 and the second sub-frame 110*b* at the proximal side 314, the first sub-frame 110*a* and the second sub-frame 110*b* couple via the frame receiving end 310 of the leg 300. For instance, the proximal end 114 of the second sub-frame 110*b* has a connector or interlocking means (e.g., the open-slotted connector) that mates with a connector or interlocking means of the distal end 112 of the first sub-frame 110*a*. Additionally or alternatively, the first sub-frame 110*a* and the second sub-frame 110*b* may couple to (e.g., interlock with) a respective leg 300 (e.g., the first leg 300, 300*a*) without an interconnection occurring between the first sub-frame 110*a* and the second sub-frame 110*b*. In yet other configurations, the first sub-frame 110*a* and the second sub-frame 110*b* couple or interconnect without fastening to the leg 300. In other words, the leg 300 may be used to guide the coupling of the sub-frames 110 without further engagement.

Figure 6A:
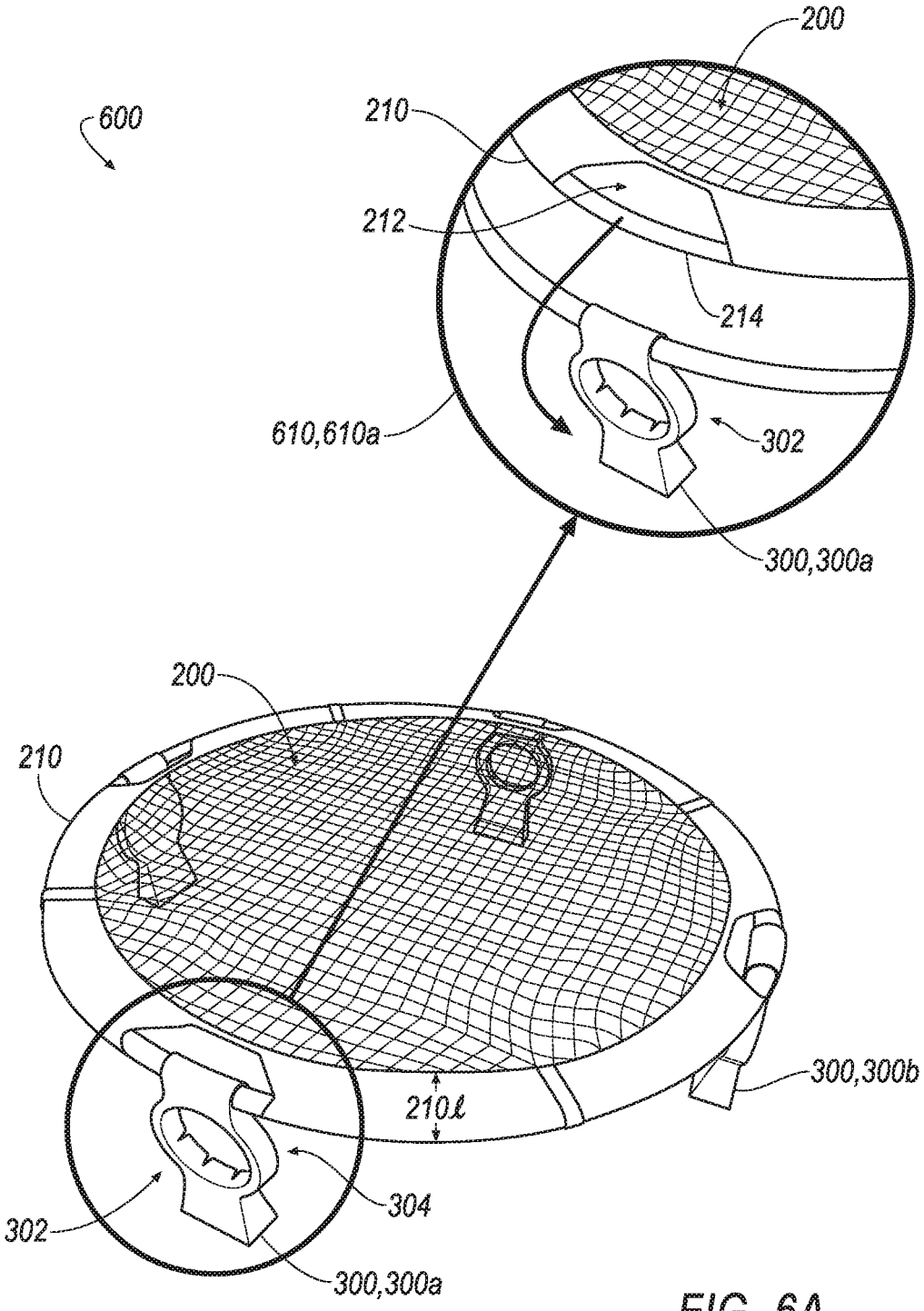
FIGS. 6A-6C are perspective views of operations for an elastic cover assembly process.
Figure 6B:
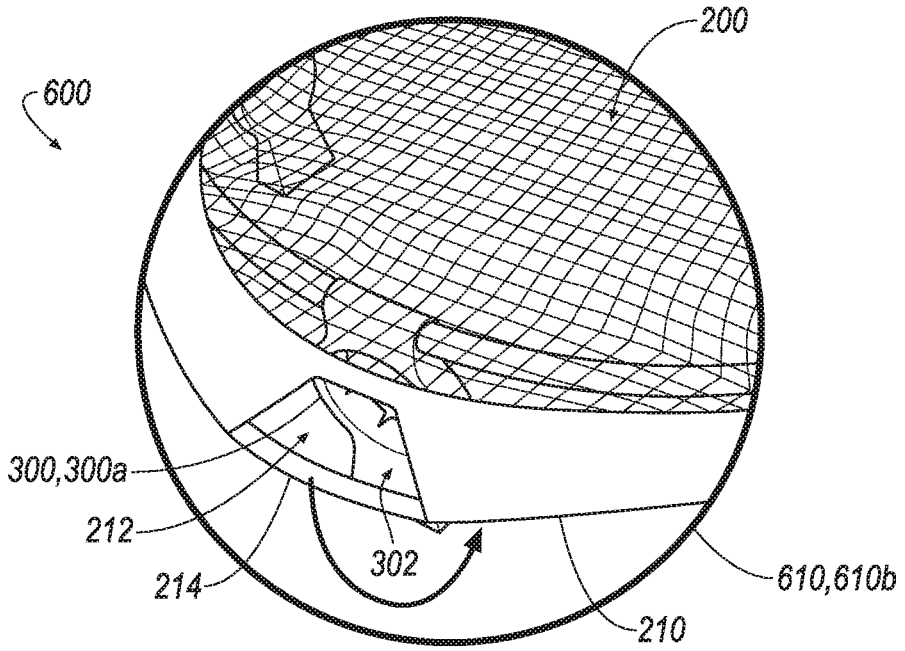
Figure 6C:
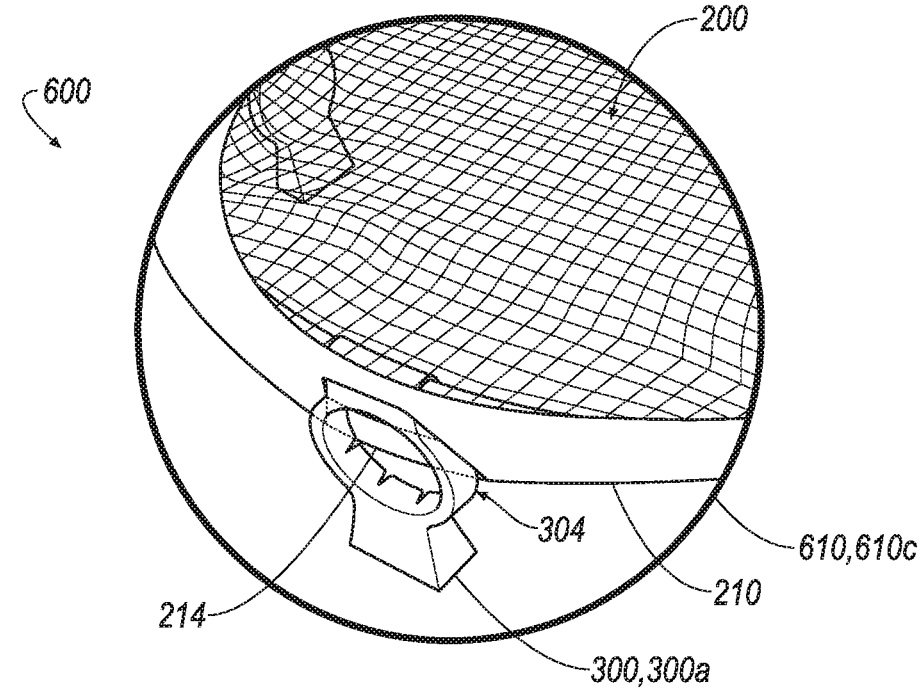

FIGS. 6A-6C are examples of the elastic cover assembly process 600. In these examples, the elastic cover 200 includes a securing portion 210. The securing portion 210 may be sewn, stitched, adhered, laminated, fused, etc. to the elastic cover 200. In some implementations, the securing portion 210 borders or circumnavigates the elastic cover 200. In some configurations, the securing portion 210 provides added stability, rigidity, and/or strength at a location where the elastic cover 200 secures to the frame 100. In some examples, the securing portion 210 is a different material sewn or fastened to the border, edge, or circumference of the elastic cover 200. In other examples, the securing portion 210 is part of the elastic cover 200 that is reinforced for securement at the border, edge, or circumference of the elastic cover 200. For example, when the elastic cover 200 is a mat-like configuration, the mat may be folded over one or more times at the border, edge, or circumference to provide the securing portion 210. Additionally or alternatively, extra stitching or sewing at or near the border of the elastic cover 210 may form the securing portion 210 of the elastic cover 200.

In some examples, the securing portion 210 may have a securing portion length 210*l* approximately equal to or greater than a cross-sectional perimeter of the frame 100. In other words, the securing portion length 210*l* is long enough to wrap around the frame 100. With a length 210*l* greater than or equal to the perimeter of the frame 100, the securing portion 210 may reinforce stresses that the volleyball spike game 40 may suffer during use at the connection between the frame 100 and the elastic cover 200.

Referring further to FIGS. 6A-6C the securing portion 210 includes at least one opening 212. The at least one opening 212 permits the elastic cover 200 to fasten to the frame 100 without causing interference between a leg 300 and the elastic cover 200. Interference between a respective leg 300 and the elastic cover 200 may cause increased wear at a location of the interference; thus reducing a lifespan of the elastic cover 200 and/or volleyball spike game 40. In some examples, the securing portion 210 includes one opening 212 for each leg 300 of the volleyball spike game 40.

The securing portion 210 may further include a securing means 214 to hold the elastic cover 200 in place on the frame 100. Some examples of securing means 214 are straps, chords, ropes, cables, wire, etc. In some configurations, the securing means 214 is flexible to wrap around the frame 100 and/or leg 300 (as shown in FIGS. 6A-6C). For instance, the opening 212 is an aperture shaped to fit a respective leg 300 formed by the securing portion 210 and the securing means 214. Here, in FIGS. 6A-6C, the securing portion 210 includes a cutaway with a strap as the securing means 214. In these examples, the strap 214 circumnavigates a border of the securing portion 210 to form the opening 212 in conjunction with the cutaway. In some implementations, the securing means 214 (e.g., the strap) is disposed within the securing portion 210 at the border or towards an outermost edge of the securing portion 210. Some examples include that the securing means 214 is sewn into the securing portion 210 or that the securing portion 210 folds over the securing means 214.

FIGS. 6A-6C are examples of the elastic cover assembly process 600 including a sequence of operations 610, 610*a-c* that fasten the elastic cover 200 to the frame 100. In these examples, at operation 610*a* the securing portion 210 (e.g., the securing means 214) is pulled over the frame 100 at a leg 300 (e.g., shown as the first leg 300, 300*a*). Here, an arrow visually indicates a path of travel for the securing means 214 to pull over the frame 100. FIG. 6B depicts at operation 610*b* that the elastic cover 200 is in the process of wrapping around the first leg 300, 300*a*. More particularly, the securing portion 210, for example via the securing means 214, wraps around from the leg 300 from the front side 302 of the leg 300 to the rear side 304 of the leg 300. An arrow in FIG. 6B illustrates that the securing means 214, during the wrap-around process at operation 610*b*, is being pulled underneath the leg 300, such that the securing means 214 and at least a portion of the securing portion 210 complete the elastic cover assembly process 600 resting against (i.e. abutting) or adjacent to the rear side 304 of the leg 300. For example, FIG. 6C depicts, at operation 610*c*, the securing means 214 (shown as the dotted lines) and at least a portion of the securing portion 210 abutting the rear side 304 of the first leg 300, 300*a*.

Figure 7A:
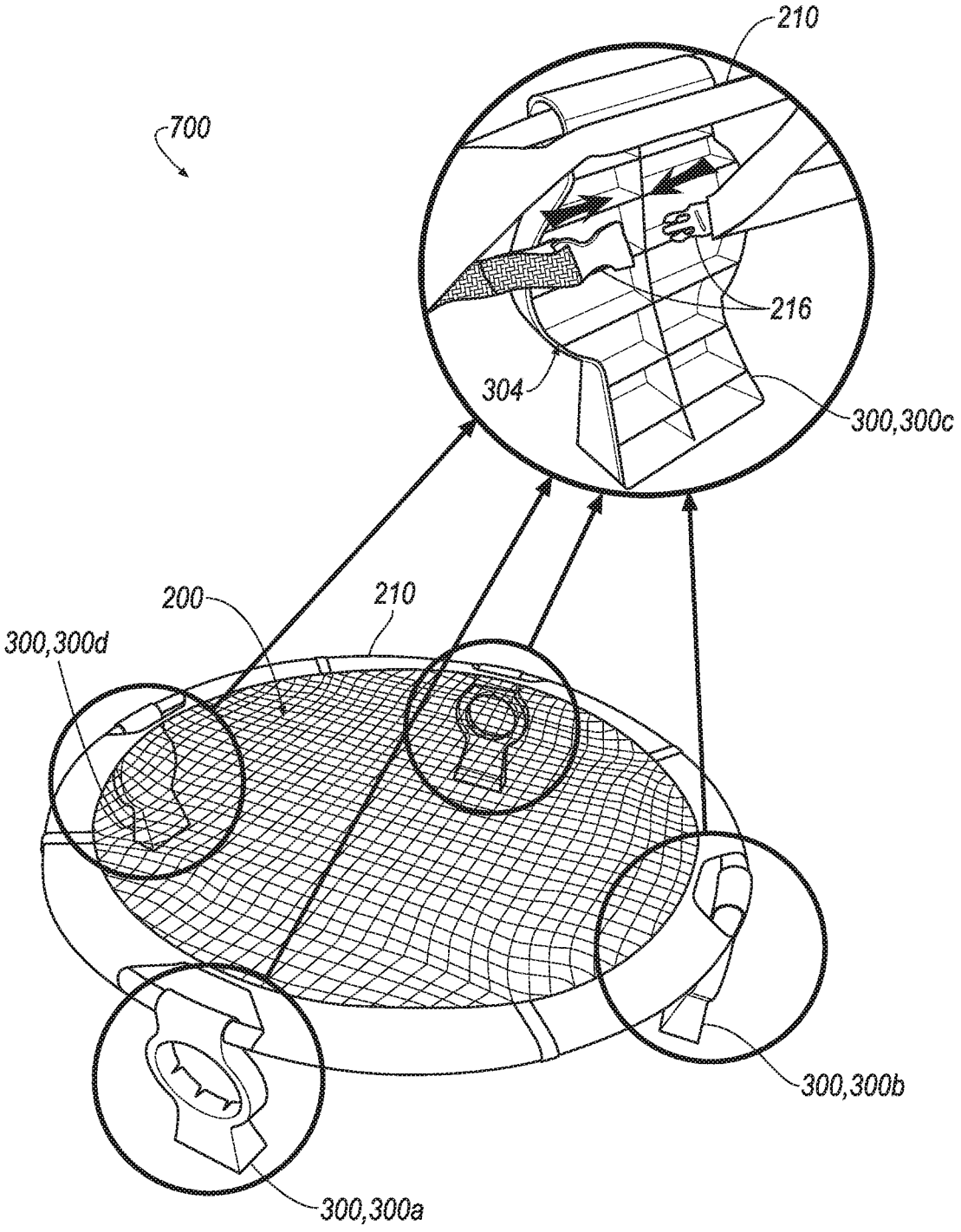
FIGS. 7A and 7B are perspective views of operations for an elastic cover securement process.
Figure 7B:
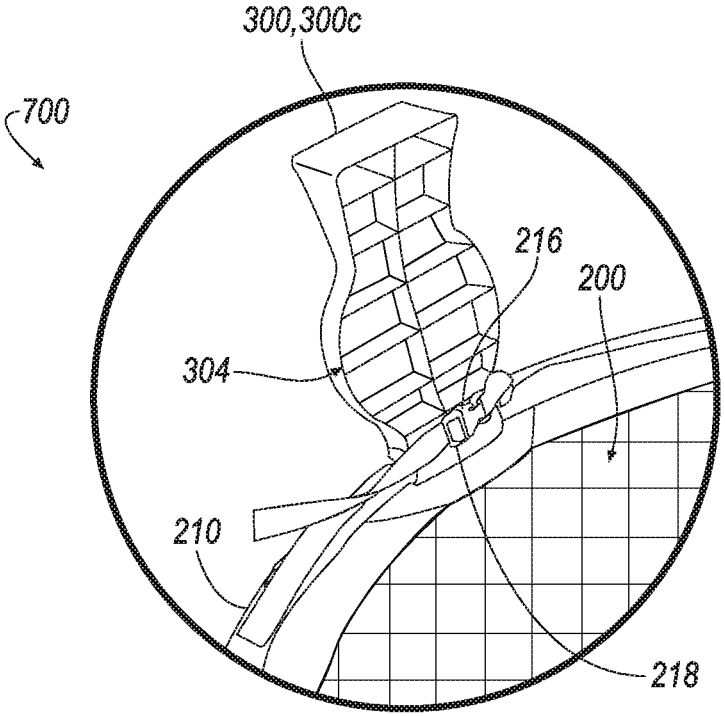

FIGS. 7A and 7B are examples of the elastic cover securement process 700. In some implementations for the elastic cover securement process 700, the elastic cover 200 includes a fastener 216 to secure a portion of the elastic cover 200 to the frame 100. Some examples of the fastener 216 include a hook-and-loop fastener or a clip and buckle fastener (e.g., a side-squeeze clip and buckle as shown in FIGS. 7A and 7B). The fastener 216 may secure a portion of the elastic cover 200 to the frame 100 in addition or alternatively to the securing means 214. In some examples, the fastener 216 is integrated with the securing means 214. In other examples, the fastener 216 is separate from the securing means 214. FIG. 7A depicts the fastener 216 fastening the elastic cover 200 to the frame 100 at the rear side 304 of a respective leg 300 (e.g., shown as the third leg 300, 300*c*). In some examples, such as FIG. 7B, the fastener 216 is also adjustable (e.g., by an adjustment device 218). In these examples, the fastener 216 may be used in combination with the securing means 214 to allow the securing means 214 to be adjustable as well.

FIGS. 8A-8D are examples of the elastic cover tensioning process 800. For the elastic cover tensioning process 800, the elastic cover 200 includes at least one tension strap 220 (e.g., four tensioning straps 220, 220*a-d*). The at least one tension strap 220 is configured to wrap around the frame 100 and provide tension for the elastic cover 200. For example, the elastic cover 200, once secured by the elastic cover assembly process 600 or otherwise, may contain slack inhibiting a performance of the elastic cover 200 when the player 20 uses the volleyball spike game 40. To reduce or to remove the slack, the at least tension strap 220 may adjustably pull the elastic cover taut against the frame 100. The at least one strap 220 may be a hook-and-loop fastener that secures around the frame 100 on itself. For example, one side of the at least one strap 220 includes a hook portion and an opposite side of the at least one strap 220 includes a loop portion capable of mating with the hook portion.

In some implementations, the at least one strap 220 includes a first strap 222 and a second strap 224. The first strap 222 and the second strap 224 may be part of the elastic cover 200, such as fastened to the securing portion 210 of the elastic cover 200, or integrated into different components of the volleyball spike game 40. For example, the first strap 222 is part of the elastic cover 200 and the second strap 224 is part of the frame 100 and/or a leg 300. When the first strap 222 and the second strap 224 are part of the elastic cover 200, the first strap 222 may be fastened to a top surface (i.e. surface facing away from a support surface of the volleyball spike game 40) of the elastic cover 200 while the second strap 224 is fastened to a bottom surface (i.e. surface facing the support surface of the volleyball spike game 40). Either strap 222, 224 may be sewn, stitched, adhered, laminated, fused, etc. to its respective component it is disposed on.

The first strap 222 and the second strap 224 may interlock or jointly tension the elastic cover 200. As an example, the first strap 222 includes a ring 226. With the ring 226 disposed on (e.g., sewn/stitched to) an end of the first strap 222, the second strap 224 may loop through the ring 226 to adjust the tension of the elastic cover 200. The second strap 224 may adjust the tension by friction upon itself or by a hook-and-loop fastener system (e.g., the second strap 224 includes both a hook portion and a loop portion to fasten on itself). In the examples of FIGS. 8A-8D, the first strap 222 is fastened to a top surface (i.e. surface facing away from a support surface of the volleyball spike game 40) of the elastic cover 200 and wraps over the frame 100 towards a support surface of the volleyball spike game 40 while the second strap 224 is fastened to a bottom surface (i.e. surface facing the support surface of the volleyball spike game 40) of the elastic cover 200 and engages the ring 226 wrapping around the frame 100 towards the first strap 222.

Figure 8A:
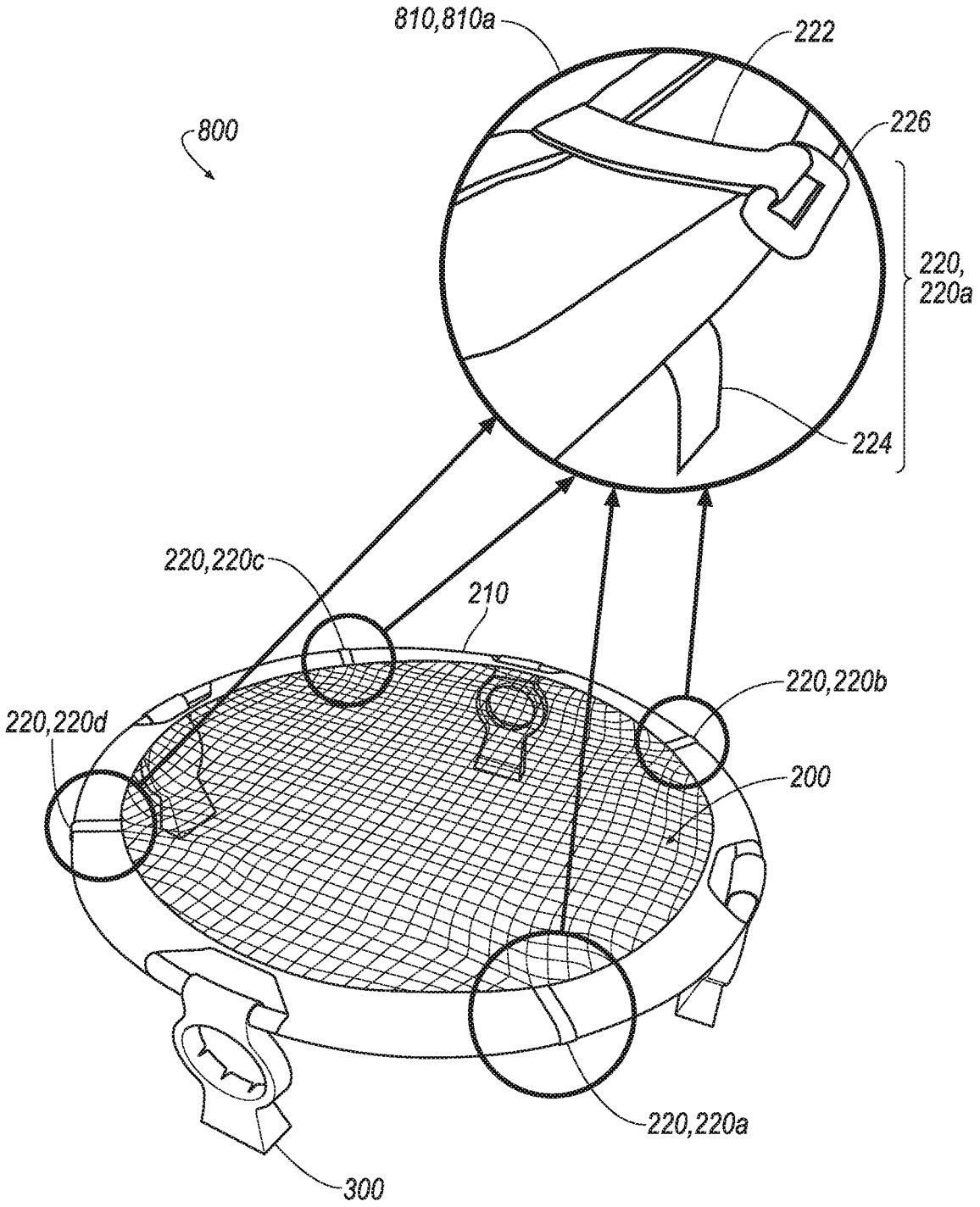
FIGS. 8A-8D are perspective views of operations of an elastic cover tensioning process.
Figure 8B:
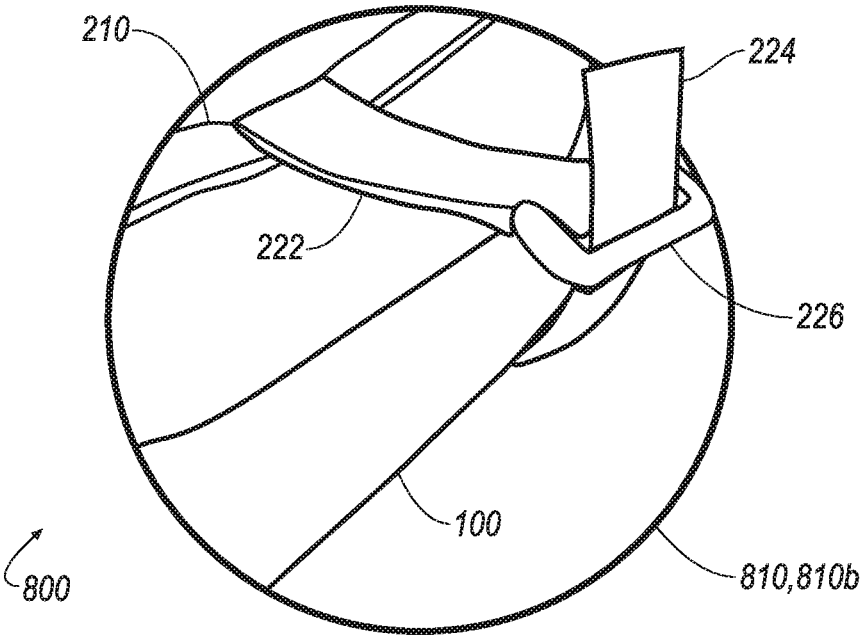
Figure 8C:
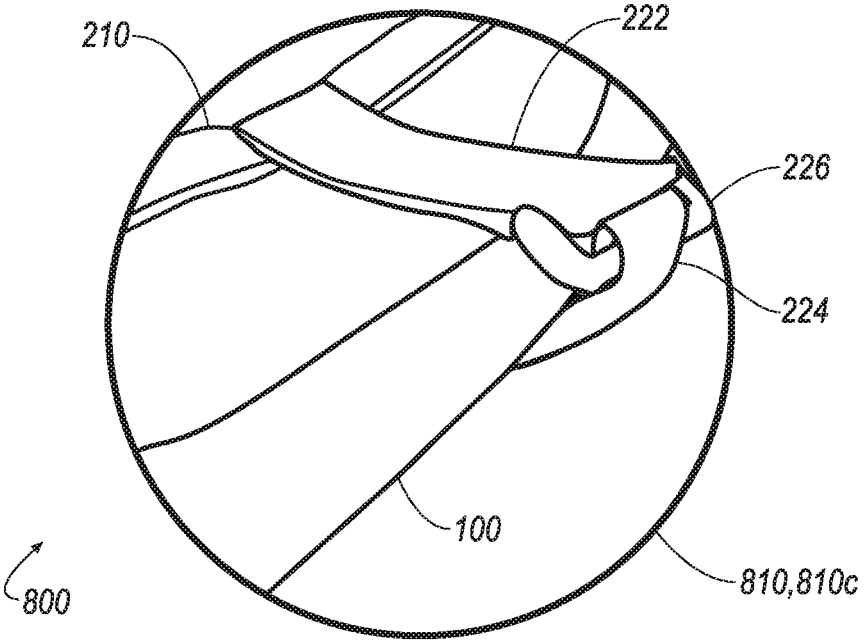
Figure 8D:
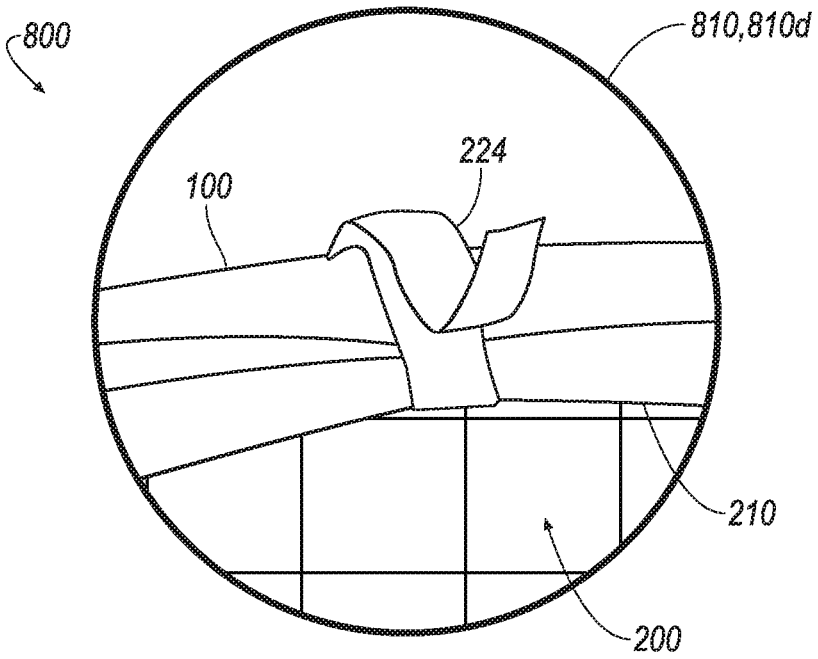

FIGS. 8A-8D depict examples of operations 810, 810*a-d* for the elastic cover tensioning process 800. In FIG. 8A, the operation 810, 810*a* includes beginning to wrap the at least one strap 220 around the frame 100 via the first strap 222 and the second strap 224. In FIG. 8B, the operation 810, 810*b* includes inserting the second strap 224 into the ring 226 of the first strap 222. Once the ring 226 receives the second strap 224, FIG. 8C depicts that at operation 810, 810*c* the second strap 224 is looped around the ring 226 back towards itself to secure attach to the ring 226. Here, the second strap 224 may be pulled taut to tension the elastic cover 200 until the tension of the elastic cover 200 is satisfactory to play the volleyball spike game 40. FIG. 8D depicts an example of an underside (i.e. side facing the support surface for the volleyball spike game 40) of the frame 100 to illustrate operation 810, 810*d* where the second strap 224 secures to itself (e.g., via the hook-and-loop fastener system) to complete the elastic cover tensioning process 800.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

What is claimed is:

1. An apparatus comprising:

a frame including a distal end and a proximal end, the distal end comprising a connector interlocking with the proximal end to form the frame;

at least one leg connected to the frame, the at least one leg comprising a frame receiving end, a ground-engaging end opposite the frame receiving end, and a ball-retaining portion between the frame receiving end and the ground-engaging end;

an elastic cover secured to the frame by a securing portion, the securing portion of the elastic cover including an opening for the at least one leg at the frame receiving end.

2. The apparatus of claim 1, wherein the opening of the securing portion prevents the at least one leg from contacting the elastic cover when the elastic cover is secured to the frame.

3. The apparatus of claim 1, wherein the securing portion includes a strap portion and a cover portion, the cover portion partially surrounding a first side of the at least one leg and the strap portion securing to a second side of the at least one leg, the second side of the at least one leg facing a center of the elastic cover when the at least one leg is in an upright, ground-engaging position.

4. The apparatus of claim 1, wherein the distal end of the frame comprises a first connector and the proximal end of the frame comprises a second connector, the first connector and the second connector interlocking with each other to form the frame.

5. The apparatus of claim 1, wherein the elastic cover secures to the frame by wrapping around an outer surface of the frame.

6. The apparatus of claim 1, wherein the frame comprises a plurality of sub-frames, each sub-frame of the plurality of sub-frames including a respective distal end and a respective proximal end, the respective distal end of a first sub-frame comprising the connector interlocking with the respective proximal end of a second sub-frame to form the frame.

7. The apparatus of claim 6, wherein the connector interlocks the distal end and the proximal end within a frame receiving opening.

8. The apparatus of claim 1, wherein the elastic cover includes at least one tension strap, the at least one tension strap configured to wrap around the frame to provide tension for a playing surface of the elastic cover.

9. The apparatus of claim 1, wherein the at least is rotatable about the frame at the frame receiving between an upright ground-engaging state and a stowed state, the stowed state positioning a respective leg approximately 90 degrees of rotation from a position of the at least one leg in the ground-engaging state.

10. The apparatus of claim 1, wherein the ball-retaining portion includes an inner wall and an outer wall, the inner wall defining a tapered opening configured to retain a ball.

11. The apparatus of claim 1, wherein the ball-retaining portion includes an inner wall extending through the leg, the inner wall having a surface area that provides a friction fit to retain a ball.

12. The apparatus of claim 1, wherein the ball-retaining portion includes a ball retaining opening, the ball retaining opening narrowing from first diameter to a second diameter, the first diameter larger than the second diameter.

* * * * *